US009790684B2

(12) United States Patent
Neumayr

(10) Patent No.: US 9,790,684 B2
(45) Date of Patent: Oct. 17, 2017

(54) MODULAR WALL SYSTEM WITH INTEGRATED CHANNELS

(71) Applicant: Michael Neumayr, Los Angeles, CA (US)

(72) Inventor: Michael Neumayr, Los Angeles, CA (US)

( * ) Notice: Subject to any disclaimer, the term of this patent is extended or adjusted under 35 U.S.C. 154(b) by 0 days.

(21) Appl. No.: 15/011,568

(22) Filed: Jan. 31, 2016

(65) Prior Publication Data

US 2017/0121976 A1 May 4, 2017

Related U.S. Application Data

(63) Continuation-in-part of application No. 12/901,700, filed on Oct. 11, 2010, now Pat. No. 9,249,572.

(51) Int. Cl.

| | |
|---|---|
| ***E04C 2/34*** | (2006.01) |
| ***E04C 2/32*** | (2006.01) |
| ***E04C 2/52*** | (2006.01) |
| ***E04B 2/02*** | (2006.01) |

(Continued)

(52) U.S. Cl.

CPC ..... *E04C 2/3405* (2013.01); *E04B 2/02* (2013.01); *E04B 2/44* (2013.01); *E04C 2/322* (2013.01); *E04C 2/324* (2013.01); *E04C 2/326* (2013.01); *E04C 2/46* (2013.01); *E04C 2/523* (2013.01);

(Continued)

(58) Field of Classification Search

CPC ..... E04C 2/3405; E04C 2002/3455; E04C 2002/3444; E04C 2/324; E04C 2/322

USPC ..... 52/264, 267, 265, 270, 783.1, 783.11, 52/783.17, 793.18, 783.19, 798.1, 220.1, 52/220.2, 220.4, 582.1, 586.1, 586.2

See application file for complete search history.

(56) References Cited

U.S. PATENT DOCUMENTS 1,987,798 A * 1/1935 Siegfried ..... F16L 59/07 261/112.2

2,034,489 A * 3/1936 Scherer ..... E04C 2/3405 220/DIG. 9

(Continued)

OTHER PUBLICATIONS

International Search Report, International Application No. PCT/US2017/015678, dated Apr. 21, 2017, 3 pages.

*Primary Examiner* — Adriana Figueroa

*Assistant Examiner* — Jessie Fonseca

(74) *Attorney, Agent, or Firm* — Creativenture Law, LLC; Dennis J M Donahue, III

(57) ABSTRACT

Prefabricated wall assemblies for the construction of buildings have a corrugated panel and preferably include at least one backside panel. The corrugated panel has one or more vertical channels and several horizontal channels. The vertical channels extend the entire panel height and are recessed from the front face. The horizontal channels extending the entire panel width and are also recessed from the front face so they intersect with the vertical channel. The horizontal channels are almost as wide as the vertical channels, and are greater than one-half the channel width of the vertical channel. The backside panel is connected to the corrugated panel to form a structural panel assembly. The backside panel can be a shear panel or other backside flat panel, a backside corrugated panel symmetrically mirroring the corrugated panel, a backside corrugated panel asymmetrically mirroring the corrugated panel, a sandwiched corrugated panel, or any combination thereof.

27 Claims, 24 Drawing Sheets

(51) Int. Cl.
*E04B 2/44* (2006.01)
*E04B 2/00* (2006.01)

(52) U.S. Cl.
CPC ..... *E04C 2/525* (2013.01); *E04C 2002/3444* (2013.01)

(56) References Cited

U.S. PATENT DOCUMENTS 2,039,601 A * 5/1936 London ..... E04B 1/74 428/116
2,065,433 A 12/1936 Dercum et al.
3,024,879 A * 3/1962 Kandra ..... E04C 2/3405 219/137 R
3,321,826 A * 5/1967 Lowy ..... B21D 47/00 29/423
3,975,882 A * 8/1976 Walter ..... E04C 2/40 156/210
4,037,379 A * 7/1977 Ozanne ..... E04C 2/3405 52/404.3
4,580,379 A * 4/1986 Nusbaum ..... H02G 3/283 174/482
4,832,308 A * 5/1989 Slonimsky ..... E04G 9/02 249/189
4,943,185 A * 7/1990 McGuckin ..... E02D 31/02 210/170.07
5,600,928 A * 2/1997 Hess ..... E04C 2/322 428/158
5,928,764 A * 7/1999 Costi ..... E04B 7/205 428/141
6,085,485 A * 7/2000 Murdock ..... E04B 7/20 52/309.11
6,205,725 B1 * 3/2001 Butler ..... E02D 27/00 52/292
6,209,273 B1 * 4/2001 Jeffers ..... E04B 2/7448 52/220.7
6,260,323 B1 * 7/2001 Hockey ..... E04B 2/74 52/238.1
6,848,233 B1 * 2/2005 Haszler ..... B23K 20/122 148/440
7,127,865 B2 * 10/2006 Douglas ..... E02D 27/02 52/270
2002/0088199 A1 * 7/2002 Linn ..... E04C 2/26 52/745.19
2003/0041547 A1 * 3/2003 Gosselin ..... B27N 5/00 52/630
2004/0074206 A1 * 4/2004 Tanase ..... E04B 1/86 52/783.17
2011/0099932 A1 * 5/2011 Saulce ..... E04B 2/845 52/426
2012/0317923 A1 12/2012 Herdt et al.

* cited by examiner

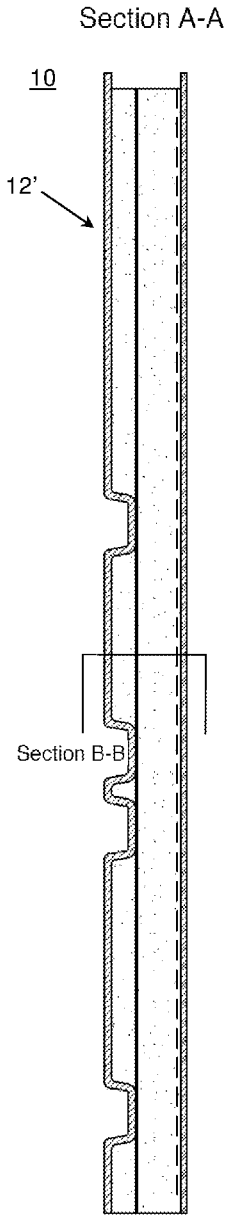
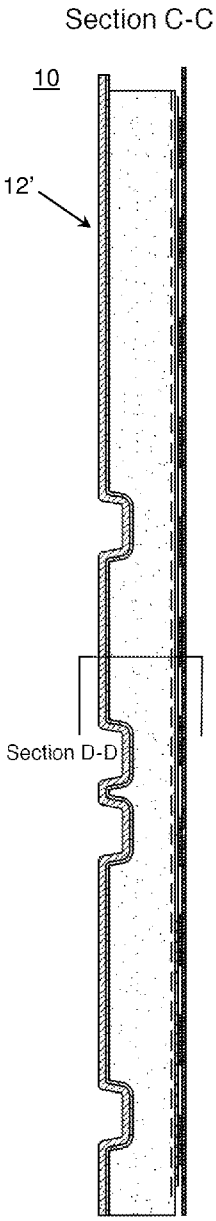
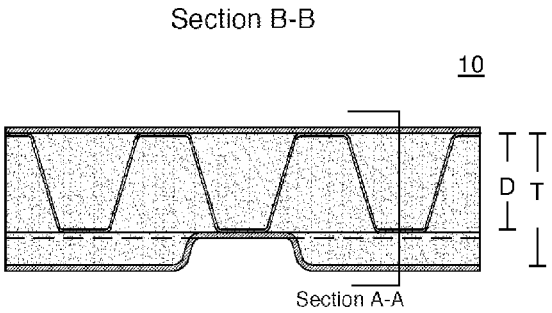
FIG. 12B
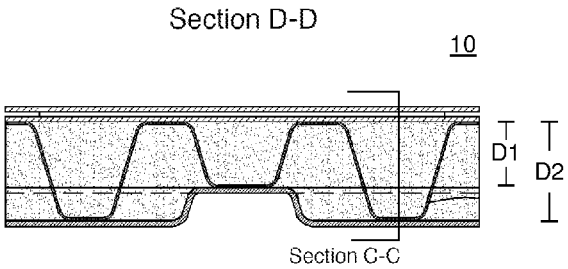
FIG. 12D
FIG. 12A FIG. 12C

10
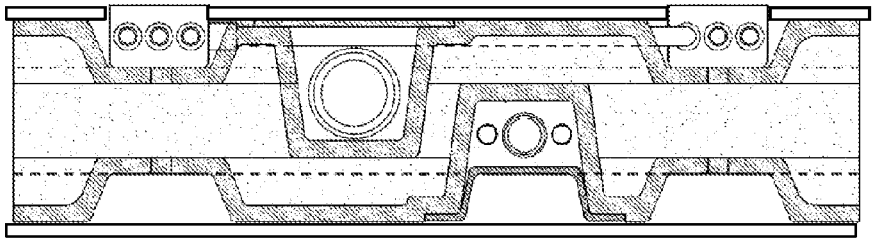
FIG. 18A
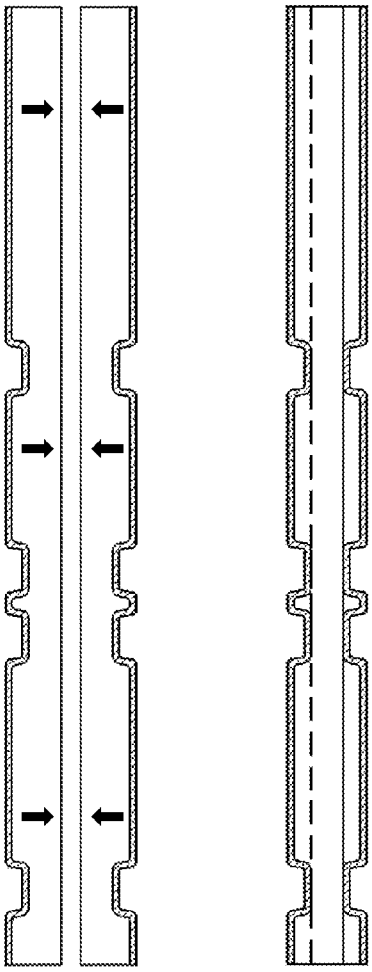
FIG. 18B
FIG. 18C
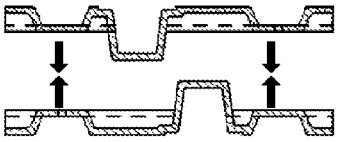
FIG. 18D
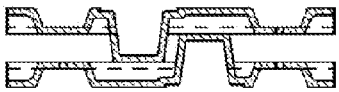
FIG. 18E

MODULAR WALL SYSTEM WITH INTEGRATED CHANNELS

CROSS-REFERENCE TO RELATED APPLICATIONS

This application is a continuation-in-part of U.S. patent application Ser. No. 12/901,700 filed on Oct. 11, 2010 which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention pertains to modular wall systems formed with installation channels for various conduits and junctions, including electrical power, electrical communication, plumbing, central vacuum, and heating, ventilation and air conditioning (HVAC).

Related Art

The invention relates to prefabricated modular building construction and units utilized in that construction. Prefabricated building components are used for construction because of their efficiency in installation which can potentially have expense cutting aspects and the reduction in the depletion of natural resources.

Historically the use of 2×4 studs of wood or other lumber of standard dimensions were most commonly used to fabricate the interior and exterior portions of buildings. Skilled tradesmen and a significant amount of time are needed for the fabrication of buildings by this traditional method of building construction. While prefabricated walls made from studs are available, the weight of the units makes them less efficient for installation. These prefabricated walls do not overcome the issue of the depletion of natural resources because they use standard lumber, the manufacturing of which involves a significant amount of waste material. Due to the weight and size of these types of prefabricated walls there are issues with shipping and storage. The installation of elements such as electrical, plumbing, and heating and cooling elements requires drilling, threading, blocking or other time consuming methods for installation because there are no channels for the horizontal placement of these systems.

Other systems using prefabricated walls use materials such as metal sheets or poured concrete or cement forms. These types of systems have been unable to overcome the need for skilled tradesmen for installation. Additionally the prefabricated components are heavy and are unable to be installed without the use of specialty equipment such as cranes, lifts, or other heavy mechanical equipment. In addition, many of the systems have been unable to accommodate plumbing, electrical, and HVAC or are make it difficult to install these systems because of the inability to directly install without feeding the systems through complex or small openings. Many of the systems additionally have not been made of materials that help cut costs and reduce the use of non-renewable resources, or are cumbersome and installation is inconvenient and time consuming.

One such system attempted to overcome some of the issues with standard framing techniques: U.S. Pat. No. 6,584,740 and U.S. Pat. No. 5,440,846. However, the system is made with non-renewable materials, doesn't accommodate the electrical, plumbing and HVAC systems in an easy to install manner, and are unable to work with existing structures. The system is designed to be a fully assembled system whereby the users have to use all components of the system in order to develop an entire structure. Thus, the system is unable to be integrated into already developed structures.

Thus, a prefabricated building system made of renewable materials that helps reduce waste, that is easy to install, store and ship is needed. Additionally a prefabricated system that and enables the installation of electrical, plumbing, HVAC, and insulation to be installed vertically and enables easy installation of electrical and plumbing in the horizontal direction without the need for threading, blocking or other time consuming installation issues, has yet to be developed.

SUMMARY OF THE INVENTION

According to various aspects of the present disclosure, there are provided multiple descriptions of the present invention. The present disclosure includes a prefabricated wall assembly that is made from materials which are otherwise waste products in the agricultural and forestry industry. The prefabricated building components in the present disclosure are made of natural fast growing plant fibers, such as wood chips or annually re-growing agricultural byproducts or waste products like straw, sorghum grass, corn husks, corn stalks, or corn stover, agave, coconut or bamboo fibers or similar suitable natural fibers. The present system also helps in overcoming the need for waste disposal of these byproducts in their respective industries.

In addition to overcoming the need to utilize the waste associated with the above disclosed industries, utilizing these plant fibers generates a second form of income for farmers and companies in these industries as the byproducts of farming can now be utilized as viable building materials. The use of this abundant waste product allows for the construction of the present invention to be lower in terms of raw materials costs, lower production prices, and higher profit margins for manufactures enabling a delivery of a sustainable product of equal or lower cost than conventional lumber or prefabricated metal structures. These prefabricated structures can be utilized in both new and redesigned structures because of the unique way the prefabricated structures enable all components in modern buildings (electrical, plumbing, central vacuum, and HVAC) to be run through the structures. Additionally, color coded areas which enable the ease of construction and can reduce waste by 10-15% from conventional building methods.

In one embodiment of the present disclosure the trapezoidal design of the system creates a stronger and more resilient and lighter construction. This enhances the ease of installation but also the overall sturdiness to the structure. As a closed system the wall panel system withstands stronger shear, compression and torsion forces while utilizing less material to achieve these enhanced structural properties. The panels are capable of being cut to length so that they can be utilized to build a particular desired sized structure. Additionally windows, doors and other elements can be cut into the structures for installation of these additional elements in construction.

The prefabricated wall panels in one embodiment of the present disclosure are equal or similar to standard building materials in size and thus can be installed by one or two men, eliminating the need for cranes, advanced delivery systems and installation materials, overcoming some of the obstacles of other prefabricated systems. In one embodiment the system can be mixed with conventional framing techniques and used in concert with conventional tools for installation reducing the need for a set of separately skilled laborers for the installation. Many of the other prefabricated systems, using metal or other materials are unable to accommodate horizontal and vertical installation of electrical, plumbing, central vacuum and HVAC systems. In addition, the way the channels are formed eliminates the need to thread these systems through the preformed panels. Thus, enabling the current invention to partner in both new and existing structures, while reducing time and the need for additional blocking, drilling, fishing, and feeding.

The corrugated core is the primary structural panel for the prefabricated wall assemblies. The corrugated panel is generally trapezoidal in shape in one configuration and is substantially planar with horizontal channels intersecting one or more vertical channels in another configuration. The corrugated panel creates one or more vertical channels running from ceiling to floor in the assembled unit. According to the trapezoid corrugated panel configuration, the vertical channels open alternately toward the interior and exterior of the corrugated panel. According to the intersecting channel corrugated panel configuration, the vertical and horizontal channels are recessed from the front face of the panel and are preferably mated with a structural foam core and or a backside panel. In conjunction with outer and inner shear panels, the vertical spaces create room for the installation of thermal insulation or the vertical installation of electrical, plumbing and HVAC. A chamber/channel running along each of the sides of the wall panel acts as a location for insertion of connectors and runs vertically between the corrugated panel and the external shear panel. This chamber/channel enables multiple prefabricated wall assemblies to be attached together with a straight connector to form sections of a straight wall or with a corner connection to produce walls with various angles, 90 degrees being the common angle utilized for standard construction. However, a variety of connection angles can be used to accommodate all needs.

On the interior side of the trapezoidal corrugated panel embodiment of the invention are recessed horizontal channels. As indicated above, the intersecting channel corrugated panel embodiment of the invention also has recessed horizontal channels which intersect with one or more vertical channels. The horizontal channels provide space for the installation of standard electrical outlets, light switches and other electrical implements, and the horizontal installation of plumbing. The horizontal channels are positioned at standard heights for bottom wall electrical outlets ($h_1$), mid-height wall outlets and switches for general purpose and kitchen counter height ($h_2$, $h_3$), and another for standard upper wall outlets and j-boxes for wall sconces ($h_4$) and respectively for plumbing like the installation of fresh water and waste water lines underneath sinks with supply lines for surface or wall mounted faucets at standard heights. An interior shear panel is attached to the inside surface of the trapezoidal panel by adhesive fasteners such as glues, resins, epoxies, mechanical fasteners such as nails, screws, rivets, or other similar fastening means used independently or with multiple means. Drywall can be attached over the shear wall panel or over the intersecting channel corrugated panel as in standard framing and construction.

The trapezoidal corrugated panel and intersecting channel corrugated panel configurations can be varied in several different combinations and arrangements to create various types of interior walls and exterior walls. For example, the intersecting channel configuration can be used in combination with a trapezoidal panel or can be used on its own as a shear panel and core structural support. For an exterior wall in which horizontal channels are primarily required only on the interior side of the wall, the planar intersecting channel panel can be selected for the interior panel and can be mated with a flat shear panel on the exterior side. For interior walls, horizontal channels are more likely going to be used on both sides of the wall so two intersecting corrugated panels are preferably connected in a back to back configuration. In one arrangement, the back to back panels can symmetrically mirror each other or can asymmetrically mirror each other to achieve horizontal channels on both sides of the wall. In yet another arrangement, adjacent panels with horizontal channels on one side can face in different directions so that the horizontal channel is on one side of the wall for one of the adjacent panels and the horizontal channel is on the other side of the wall for the other one of the adjacent panels. Holes are prefabricated in the panels or can be cut into the panels to connect to the horizontal channels on the opposite sides of the wall and allow the conduits to traverse the wall from the horizontal channel on one side of the wall to the horizontal channel on the other side of the wall.

Channel connectors can be inserted between two adjoining prefabricated wall segments or completed assemblies. The channel connector is complimentary in shape to the chamber/channel that runs vertically along the sides of the prefabricated wall assembly. The channel connectors are the male counterpart to the female chamber/channel. The channel connectors can be fabricated from material similar to the prefabricated wall assemblies or can be made of other materials such as wood, metal, polymers, plastics, composites, or the like. Channel connectors can have a variety of shapes. In one embodiment the channel connector is comb shaped on either side and each side fits into a similarly shaped chamber/channel. The channel connectors can be simply rectangular in shape, have semicircle protrusions or any other structure similar in nature without departing from the scope of the present disclosure.

A corner can be generated by connecting two units to form an angle at a corner post. Corner posts can be made of standard lumber materials, metal, plastics, or other suitable resources. The corner post is mechanically fastened to each prefabricated wall assembly with the additional support of a post cap. The post cap has two legs that are attached to form an angle. Each leg of the post cap has male components similar in shape to the channel connectors and are inserted into the same vertical chambers as the channel connectors. These corner connectors wrap around a standard lumber post which provides structural stability to the connector. In addition to the channel connectors, hold down bolts and hold down brackets are inserted through the corner post and post caps into the prefabricated wall assembly from both sides of the corner.

Thermal insulation can be made from various materials offering superior quality. The insulation will be inserted in the outer insulation channels during production prior to the attachment of the outer shear panel. Additionally, insulation can be installed in channels before or after installation of the wall segments by either cutting insulation to fit or using spray or foam type insulation into the core. Insulation also can be installed on the interior opening vertical chambers prior to attachment of the interior shear panel, again either during production or during installation of the prefabricated wall assemblies. Insulation can also be installed in the exterior opening vertical chambers either before or during installation.

An interior channel brace is located internal to the interior shear panel and is screwed or nailed or fixed by some other similar mechanism into the sides of the core channel in the corrugated core. The channel brace is generally shaped the same as the trapezoidal shape of the corrugated core so as to provide additional integrity to the structure. The channel braces provide additional structural strength where needed, for example for the attachment of a wall connector which runs perpendicular to the main wall segment. It also provides additional mounting surface to which vertical wall rails can be attached by mechanical fasteners such as nails, screws, staples, rivets, glue, or the like, in solo or in combination.

Top plates and bottom plates are attached to the core and run parallel to each other at the top and bottom of the wall segment, respectively. Bottom plates are attached to the floor through mechanical fasteners. Bottom plates have a base and two parallel protrusions running from the base into the corrugated core and the outer shear panel. The bottom plates provide guides for installation of the prefabricated wall assemblies and provide attachment to the individual assembly. The top plates consist of a body and two vertically oriented rails protruding from the body into the corrugated core, mirroring the bottom plates. The vertical protrusions act as guides as well as attachment points for the core and outer shear panel. Wall rails are of similar design as the bottom and top rails and serve as anchor points for the interior walls which run perpendicular or non-parallel to the exterior walls. The wall rails are mounted to the walls vertically by mechanical fasteners such as glue, nails, rivets, screws, or similar equivalent mechanism as previously described.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings. The drawings constitute a part of this specification and include exemplary embodiments of the invention, which may be embodied in various forms. It is to be understood that in some instances, various aspects of the invention may be shown exaggerated or enlarged to facilitate an understanding of the invention; therefore the drawings are not necessarily to scale. In addition, in the embodiments depicted herein, like reference numerals in the various drawings refer to identical or near identical structural elements.

FIGS. 12A and 12C are vertical cross-sections of wall panel assemblies with trapezoidal corrugated core panels having vertical channels of different depths.

FIGS. 12B and 12D are horizontal cross-sections of the wall panel assemblies shown in FIGS. 12A and 12C, respectively.

FIG. 18A is a top view of a representative wall panel assembly with mirroring asymmetric intersecting channel panels having shallow channels.

FIGS. 18B and 18C are side views of mirroring asymmetric intersecting channel panels with moderately deep vertical channels.

FIGS. 18D and 18E are top views of mirroring asymmetric intersecting channel panels with moderately deep vertical channels.

DETAILED DESCRIPTION OF THE PREFERRED EMBODIMENTS

The following description of the preferred embodiment(s) is merely exemplary in nature and is in no way intended to limit the invention, its application, or uses.

Figures 1, 2, 3:
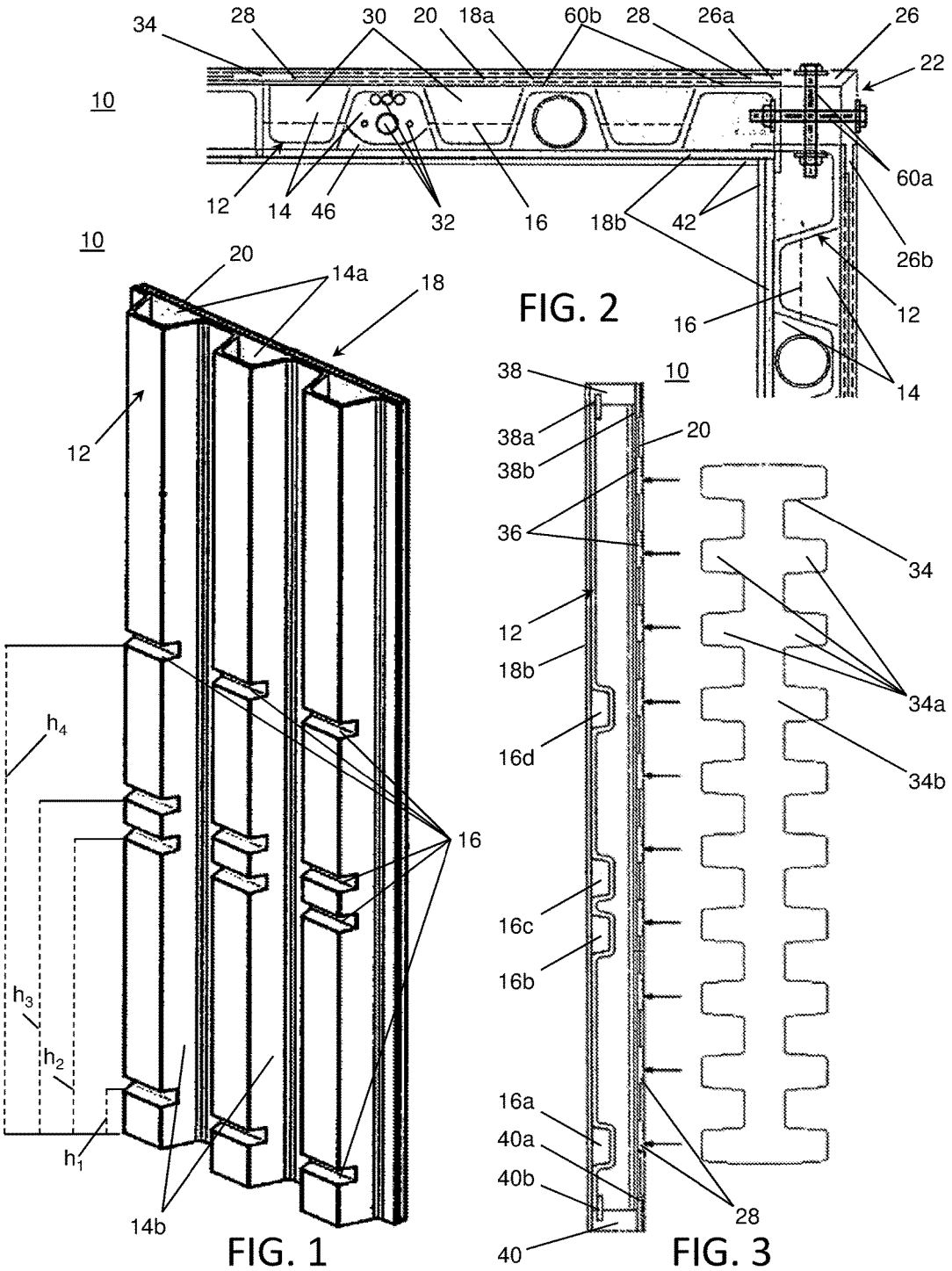
FIG. 1 depicts an isometric inside view of a wall panel assembly.
FIG. 2 is a horizontal cross-section through a corner of a wall panel assembly.
FIG. 3 is a vertical cross-section of a wall panel assembly.

FIG. 1 is an exemplary embodiment of an isometric view of the inside of a segment of a wall panel 10 according to the present invention. The cross-section shows the corrugated core 12 which provides vertical channels 14*a* for installation of insulation 30, and the conduits and components 32 for electrical, plumbing, central vacuum, and HVAC systems. Vertical chambers 14*b* in the corrugated core are generally intended for plumbing, electrical, central vacuum, HVAC and insulation. Horizontal channels 16 allow for easy installation of electrical, plumbing and HVAC systems in the interior of the structure without the need for threading as with previously designed systems. An exterior shear panel 18*a* can be cut to accommodate individual widths of each prefabricated panel system 10 and can be connected to adjacent panels at any width. The exterior shear panel is mechanically fixed to the corrugated core by means of mechanical fasteners 60*a* such as nails, screws, rivets, bolts, and staples, adhesive fasteners 60*b* such as glues, resins, and epoxies, or any similarly suitable fastener 60.

FIG. 2 is an exemplary embodiment of two units 10 connected together forming a corner 22. The image is a horizontal cross section of the two units joined in the corner by a corner post 24 and mechanical fastening means 60*a*. A post cap 26 with legs 26*a*, 26*b* that extend from either side wraps around the corner post 24 and the leg is preferably a male fitting for the slot 28 in the exterior shear panel 18*a*. The exterior shear panel 18*a* can be cut to length and installed after installation of the corrugated core 12. Vertical channels 14 run from ceiling to floor through the corrugated core 12 and enable the installation of electrical, plumbing, HVAC and insulation. Insulation batts 30 are optionally added in the prefabricated wall segment 10 either before or during installation. A channel connector 34 connects two adjacent prefabricated wall segments together by insertion of opposing two male ends 34*a* into adjacent hollow chambers/channels 36 running along either the left or the right side of the structural wall panel assembly 10.

FIG. 3 is a vertical cross section of a prefabricated wall segment assembly. A top plate 38 is attached at the top of the wall assembly and has two parallel protrusions 38*a*, 38*b* extending from the body into the corrugated core 12 and the exterior shear panel 18*a*. The top plate is attached to the corrugated core by mechanical fastening means. The bottom plate 40 mirrors the top plate 38 and is attached to the floor and the corrugated core by mechanical fastening means. The bottom plate 40 consists of a base and two parallel protrusions 40*a*, 40*b* extending from the base into the corrugated core 12 and the exterior shear panel 18*a*. The bottom plate 40 acts as a guide for the installation of the wall segment. A channel connector 34 is inserted in the chamber/channel on either side of two adjacent wall segments. The channel connector 34 can have a comb-like appearance with teeth 34*a* that project from either side of a central spine 34*b* or can have any variety of different shapes which are able to be inserted into the chamber/channel.

Four (4) series of horizontal channels 16*a*, 16*b*, 16*c*, 16*d* are provided for horizontal installation of conduits 32*a* and components 32*b* for electrical, plumbing, central vacuum, and HVAC systems. Electrical conduits 32*a*' include power lines, communication wires (such as cables for audio/video systems, telephony, internet, etc.). Plumbing conduits 32*a*" include pipes for fresh water and waste water. Tubes for central vacuum systems and ducts for HVAC system can also be run through the structural panel assemblies, although these conduits and the waste water pipes are much more likely to run in the vertical channels rather than in the horizontal channels. Electrical components 32*b* could include j-boxes 32*b*' (and wall sconces), switches and outlets. Similarly, plumbing components could also include switches and outlets at varying heights depending on the particular need according to the building design. Of course, there could be a lesser number of horizontal installation channels or even more horizontal installation channels. For example, a fifth horizontal channel may be used for a sink drain pipe where the t-trap enters the wall.

Generally, the horizontal channels of the present invention enable installation without the need for complex threading, looping, lacing or time consuming measures needs. Adjacent wall panel assemblies 10 have horizontal channels at the same height relative to the bottom plate so that the conduits can run the entire length of the wall if needed. The lower horizontal channel is proximate to the bottom side, with the pair of middle horizontal channels being proximate to the center of the corrugated panel, and the upper horizontal channel is above the center of the corrugated panel.

Figure 4A:
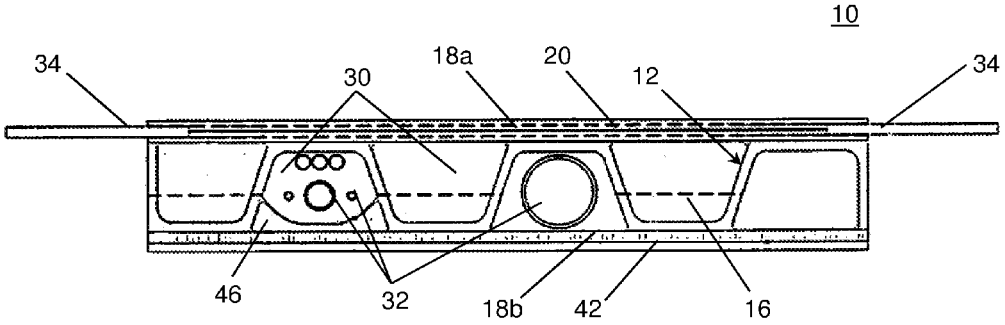
FIG. 4A is a horizontal cross-section of an installed wall panel assembly.

FIG. 4A is a horizontal section of a finished assembled prefabricated wall segment. The corrugated core 12 is the main component of the segment. The corrugated core 12 enables attachment of both an interior shear wall panel and an exterior shear wall panel 18. Channel connectors 34 enable connection of two adjacent wall assemblies with the male component to the female fitting found in the exterior shear panel 18*a* located on each side of the wall segment. The dashed line in FIG. 4A shows the depth of the horizontal channels 16 for the installation of electrical and plumbing implements at various heights ($h_1$, $h_2$, $h_3$, $h_4$) along the corrugated core (heights predetermined following standard design rules and outlet heights and are preferably ADA compliant). In addition to the horizontal channels 16, vertical channels 14 show locations for installation of electrical, plumbing, HVAC and insulation (optional) during installation of the wall segments.

Figure 4B:
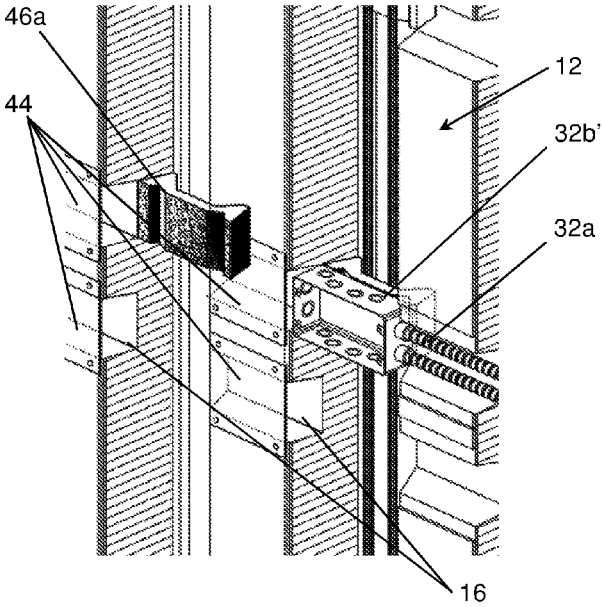
FIGS. 4B and 4C are perspective views of alternative installations of conduits, fixtures and brackets in the wall panel assembly.
Figure 4C:
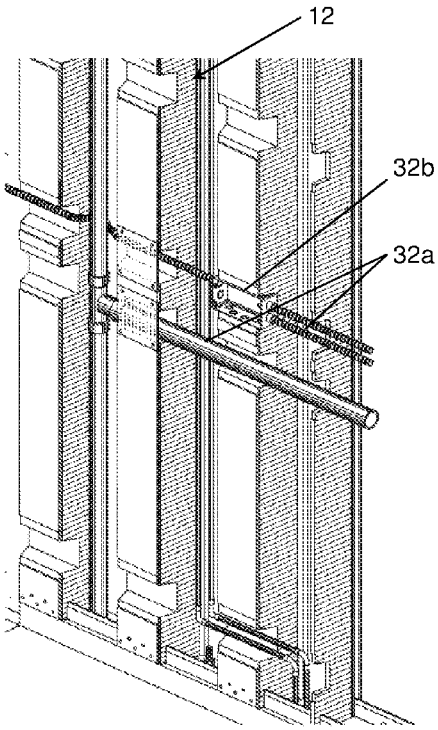

The exterior shear panel 18*a* and interior shear panel 18*b* are installed after the various conduits and components are run in the horizontal channels and the vertical channels and can be cut to various dimensions depending on the size of the corrugated core 12. FIGS. 4B and 4C show exemplary conduits 32*a* and components 32*b* that are installed in the horizontal channels and vertical channels before the walls are finished with shear panels 18 and/or wallboard 42. These drawings also show how brackets 44 and braces 46 can be used to help hold the conduits 32*a* and components 32*b* in place in the channels 14, 16 of the wall panel assemblies 10.

FIG. 4A demonstrates that drywall 42 and other types of wallboard also can be installed against the interior shear panel 18*b* during installation. Because of the unique design of the prefabricated wall segments, the segments can work with existing structures which may or may not have drywall or other commonly used surface treatments, such as plaster or other types of wallboard. It will also be appreciated that an interior shear panel may not be required. As explained in detail below, the corrugated panel could be used in combination with a structural foam and/or with another corrugated panel in a back to back arrangement which would provide sufficient strength that the panel with foam and/or mated panels also serve as the shear panels so a separate shear panel, interior or exterior, may not be required.

Various styles of channel braces 46*a*, 46*b* can be installed at various locations within the corrugated core 12 and are generally complimentary in shape and size to the trapezoidal structure of the corrugated core. Channel braces 46 generally add additional strength where needed and are mechanically fixed in place by screws, bolts, nails, glue, epoxy, resins, or similar fasteners 60. As shown in the drawings of FIGS. 4B and 4C, a localized channel brace 46*a* can be used in the vertical channel adjacent to one or more horizontal channels. Alternatively, as shown in FIG. 7, an elongated channel brace 46*b* can extend the entire length of the vertical channel.

Figure 5A:
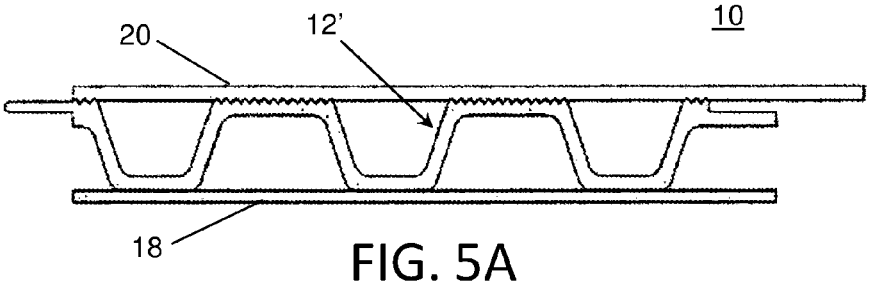
FIGS. 5A-5C are horizontal cross-sections of alternative versions for the corrugated core.
Figure 5B:
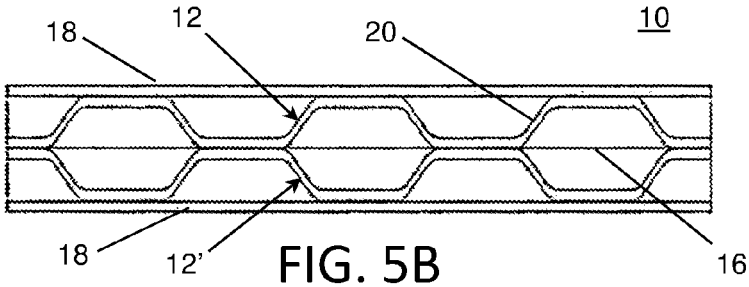
Figure 5C:
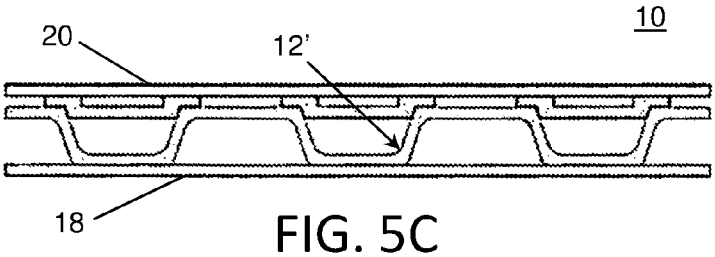

FIGS. 5A-5C show three optional versions for the structure of the corrugated core. FIG. 5A shows a front facing corrugated core 12' with a backside panel 20 attached to the solid composite corrugated core with a top joint for attaching multiple panels together (corrugated core with lap joint). It will be appreciated that the backside panel could be an interior shear panel when the wall assembly 10 is used for an interior wall or an exterior shear panel when the wall assembly 10 is used for an interior wall. Depending on the strength required for the wall panel, the panel on the front side of the corrugated core 12' could be a shear panel 18 or wallboard. FIG. 5B shows another embodiment of the present invention where two corrugated trapezoidal cores 12, 12' are buttressed together, back to back, so that the interior portion of the corrugated core creates a honeycomb or hexagonal shape (double-sided corrugated core). The shear panels 18 are attached separately, and in this case, it will be appreciated that one of the corrugated cores could serve as the backside panel 20. It is evident that horizontal channels could be formed in both of the corrugated panels 12, 12' for an interior wall or only the front facing corrugated panel 12' may have horizontal channels for an exterior wall. Alternative versions of this configuration using various arrangements of the corrugated core 12, including a variety of front facing corrugated panels 12' are described in detail below with reference to as FIGS. 9-19. FIG. 5C shows a third embodiment of the trapezoidal corrugated core 12'. In between each of the vertical channels in the exterior portion of the core are channel braces 46 for added support (corrugated core with channel braces). This particular configuration could be inverted and the channel braces would be buttressed up against the interior shear panel as an alternative design. The exterior and interior shear panels would be attached separately.

Figure 6A:
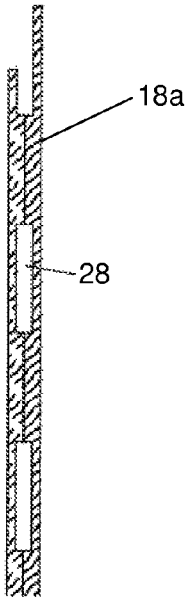
FIGS. 6A and 6B are a cross-sectional side view and a perspective view, respectively, of the outer shear panel.
Figure 6B:
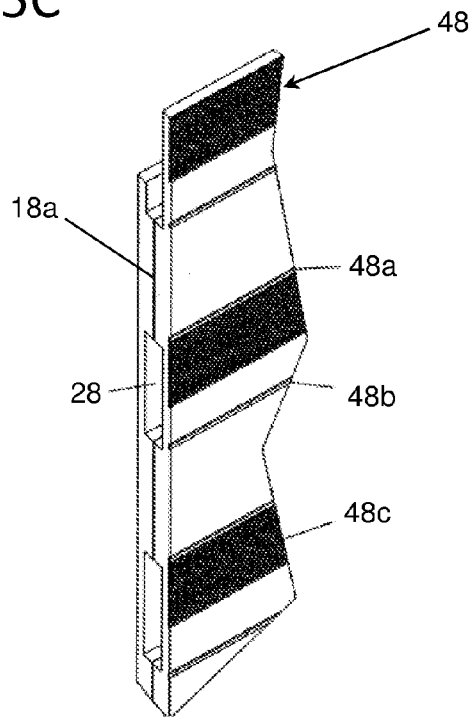

FIG. 6 depicts an isometric section of the outer shear panel 18*a*. Shadowed areas 48 define predetermined areas of the outer shear panel where the panel can be cut to allow for different wall heights. The shadowed areas allow for various cutting heights while still providing enough overlap to enable the male component 34*a* of the channel connector 34 to insert into the chamber or slot 28. The color coded regions 48*a*, 48*b* on a horizontal portion of a wall segment can also signify the lowest point where the panels can be cut and still provide enough overlap for the insertion of the top plate. Portions of the wall can be color coded by adding dye to the plant fibers to enable easier attachment of different elements of the prefabricated construction system. The lengthwise shadowed area 48*c* is also useful to show where the wall segment can be cut for any given width and still allow for connection of the top plate.

Figure 7:
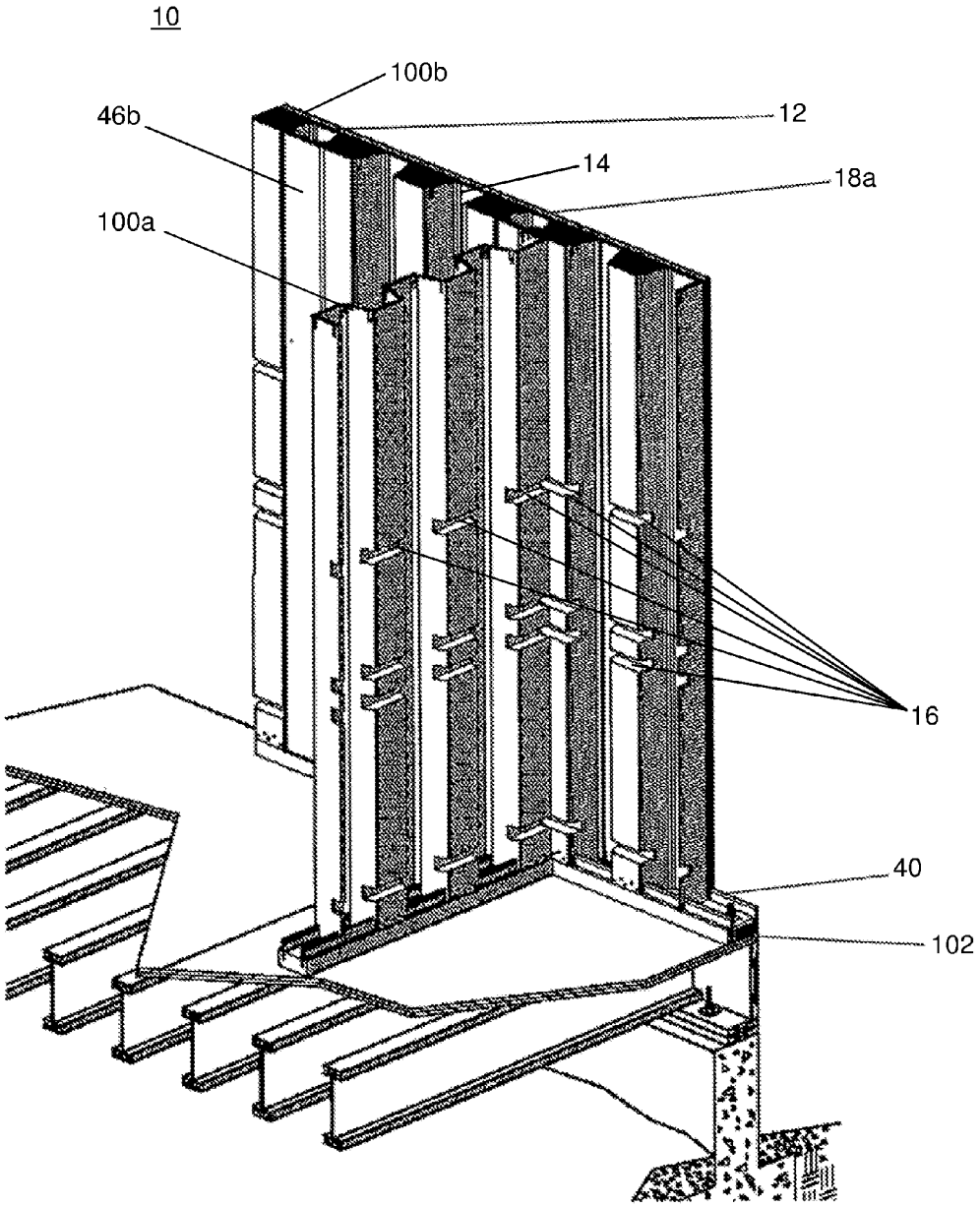
FIG. 7 is a perspective view of panel assemblies connected to form interior and exterior walls.

FIG. 7 depicts an interior wall 100*a* and an exterior wall 100*b* generated by connecting multiple wall panel assemblies 10 together at an angle. The plumbing, electrical and all other building components can be run from the channels 14, 16 in the exterior wall's assemblies throughout the channels 14, 16 of the interior wall's assemblies to reach the interior spaces of the building. As indicated above, additional support can be provided by connecting an interior channel brace 46 into the vertical spaces in the wall segment. As explained in detail below with reference to FIG. 19, the frontward facing side of the corrugated panels for adjacent wall panel assemblies can alternate the side of the wall that they face so that the conduits and components can be accessed from opposite sides of the internal wall 100*a*. Bottom plates 40 are attached to the wall segments and to the subfloor 102.

Figure 8A:
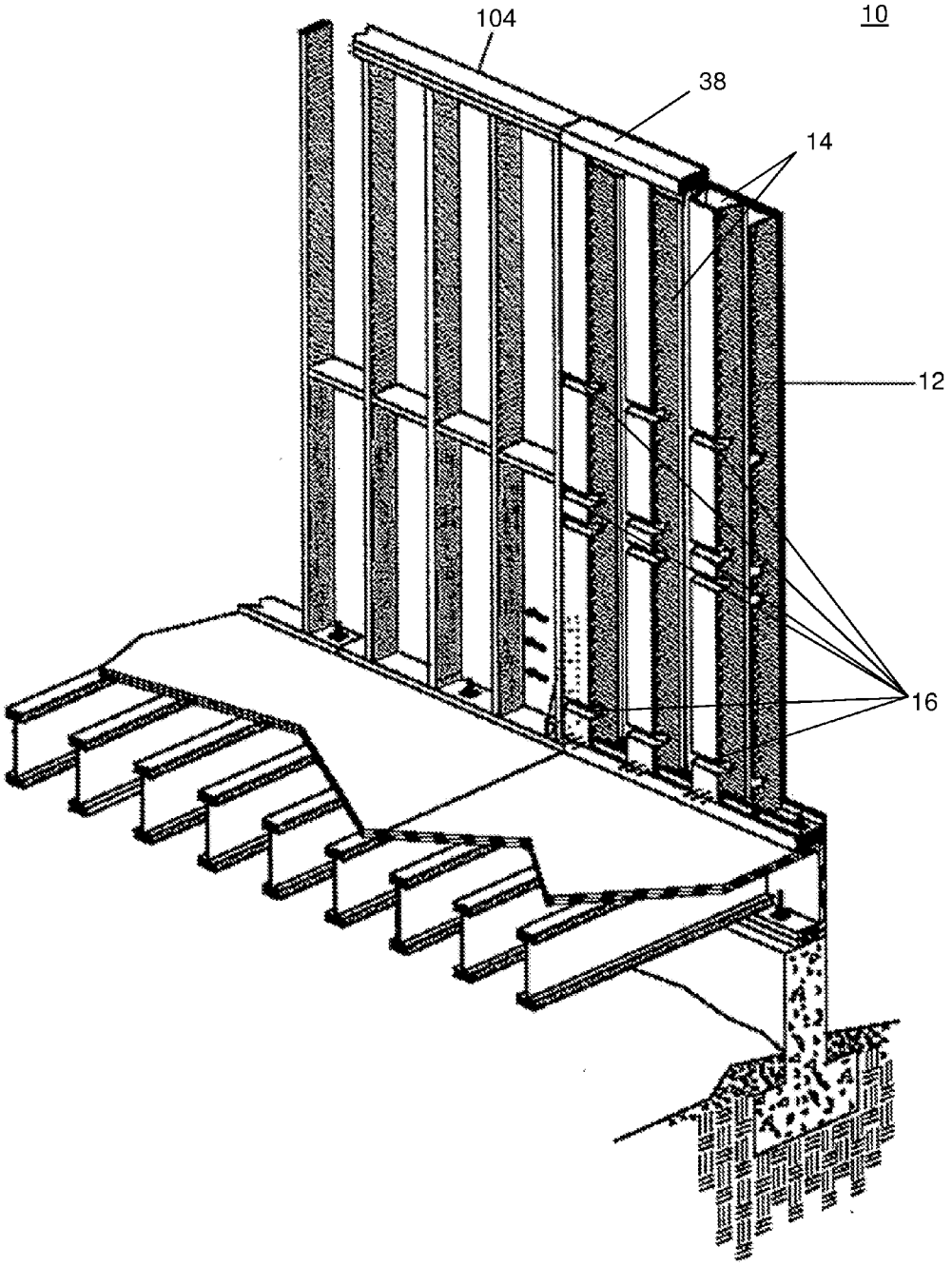
FIGS. 8A and 8B are perspective views of prefabricated exterior panel assemblies connected to standard framing.
Figure 8B:
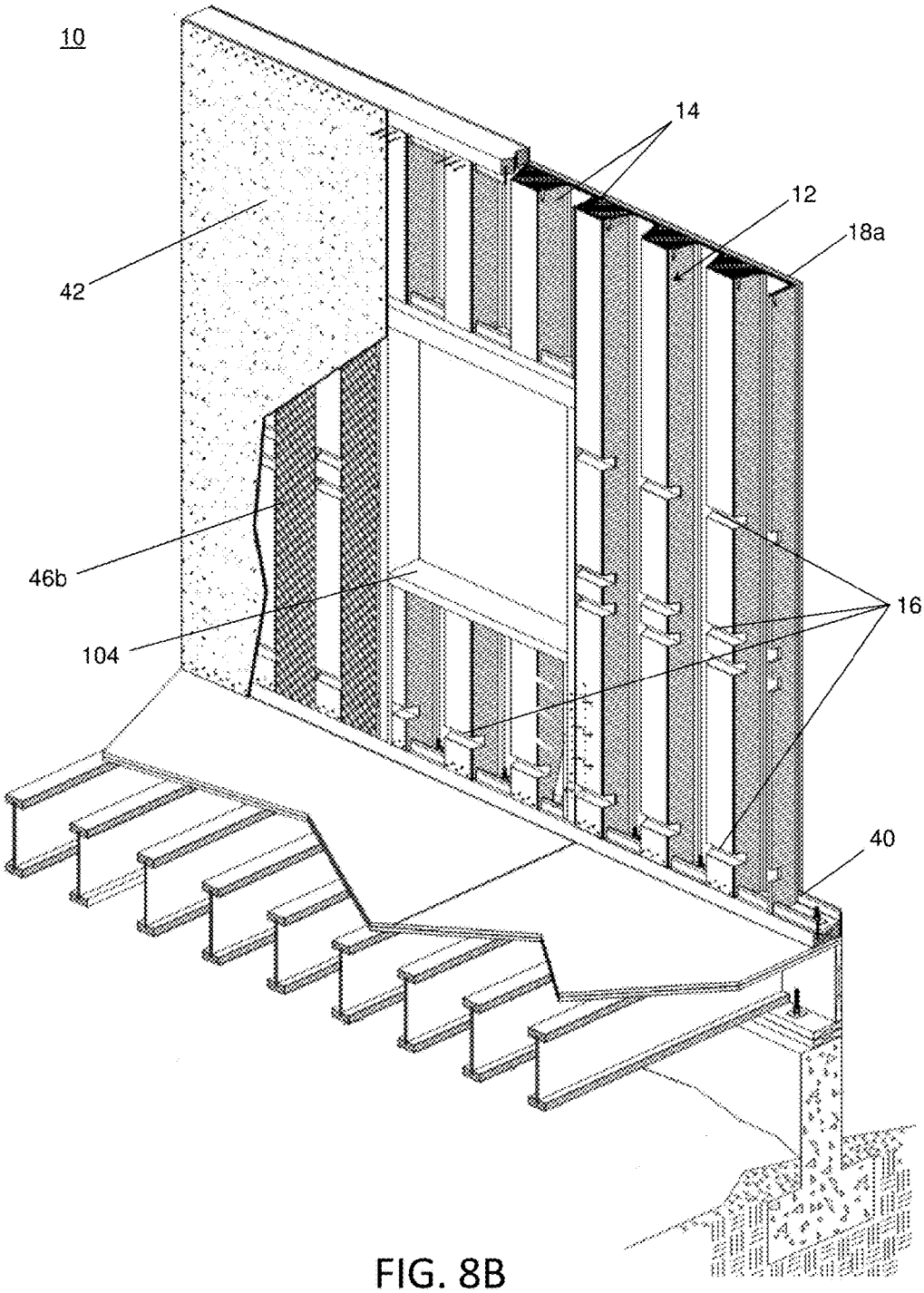

FIG. 8A depicts a portion of a prefabricated wall segment 10 connected to standard stud house framing 104. The top plate 38 of the wall panel assembly 10 connects to the double top plate used in standard stud framing. FIG. 8B shows how the wall panel assembly 10 can be cut to form various features for a building, such as a window frame 104. Even though the window frame blocks some of the horizontal channels, conduits can still be run through the horizontal channel 16 that runs along the bottom side of the wall panel assembly.

Figure 9A:
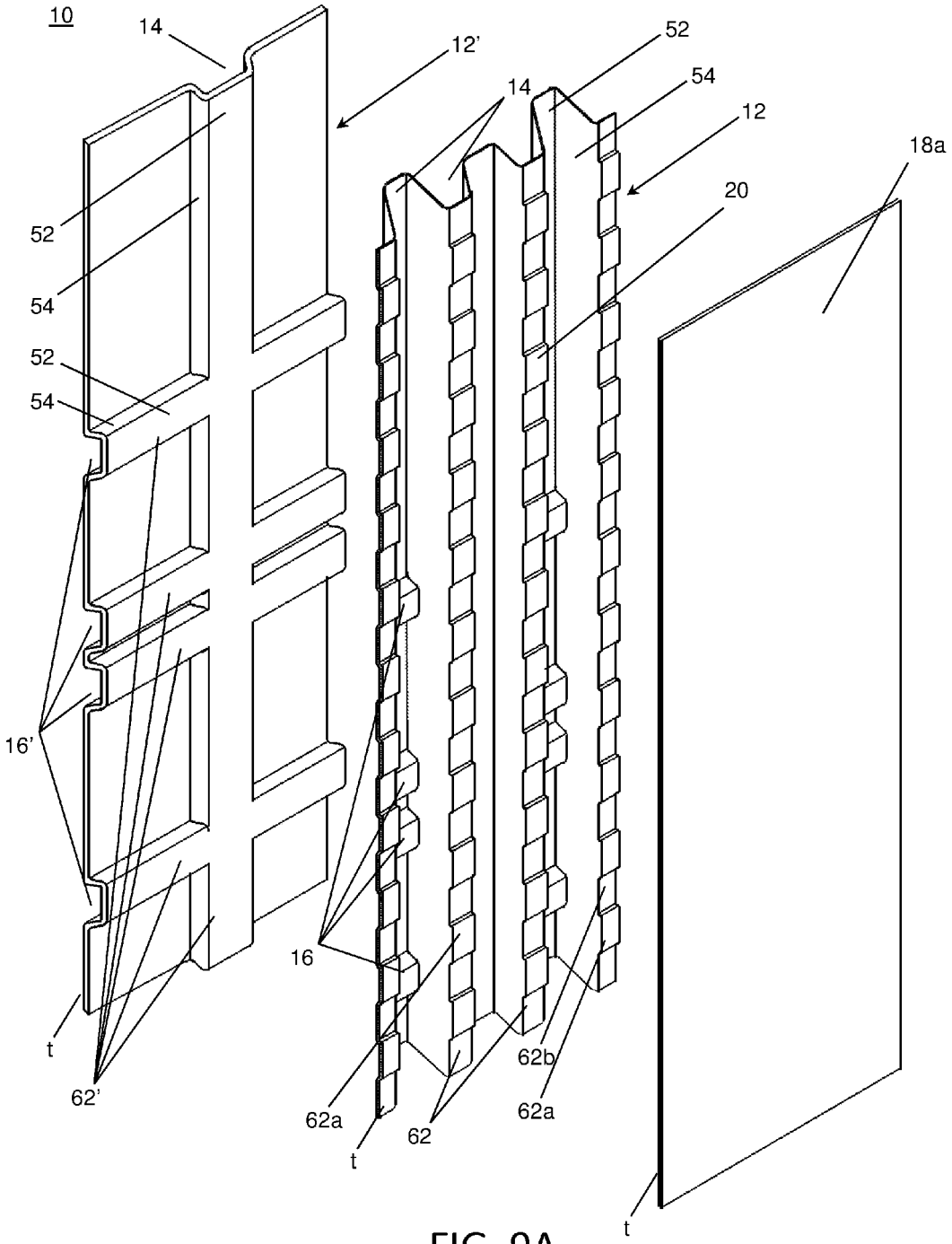
FIG. 9A is an isometric exploded view of a wall panel assembly with an intersecting channel panel, a trapezoidal corrugated core panel, and a flat shear panel.

As indicated above with reference to FIGS. 5A, 5B and 5C, the present invention encompasses alternative configurations of wall panel assemblies that have various arrangements of the innovative corrugated core 12. For example, a double-sided corrugated core embodiment is generally described and shown in FIG. 5B. The embodiment shown in FIG. 5B suggests a pair of corrugated cores that symmetrically mirror each other, but it will be appreciated that the double-sided corrugated core could have asymmetric corrugated panels and could have corrugated panels with complementary shapes without exactly mirroring each other. One such complementary shape of corrugated panels is shown in FIG. 9 and is described in detail below. Other complementary shapes are shown in FIGS. 10-14. Of course, corrugated cores that symmetrically mirror each other can come in a variety of different shapes, such as shown in FIGS. 5, 15, and 16. Corrugated cores can also asymmetrically mirror each other, such as shown in FIGS. 17 and 18. Additionally, as shown in FIG. 19, for wall panel assemblies with asymmetric corrugated panels that have horizontal and vertical channels on only one side of the panel assembly, adjacent wall panel assemblies can alternate the direction that they face so that components and other fixtures can be available on both sides of an internal wall.

Generally, regardless of whether the corrugated panel has a trapezoid horizontal cross-sectional shape 12 or is substantially planar with horizontal channels 16 intersecting one or more vertical channels 14, the corrugated panels of the present invention have one or more vertical channels in combination with horizontal channels that are recessed from the front face by either the same depth or different depths. The corrugated panels 12, 12' are rectangular with a height (H) between the panel's top and bottom, a width (W) between the side ends, a wall thickness between the front and back faces, and a corrugation depth (D) measured from a front face peak to a back face peak. The panels are preferably formed from a thin-walled material (t) so the channels 14, 16 that are recessed from the front face appear as projections on the back face. It will be appreciated that the panels could be formed from a material that is thicker than the corrugation depth so that the channels are recessed from the front face but has a flat back surface. The vertical channel has a length extending the entire panel height and a width less than one third (⅓) the panel width. The width of the horizontal channels extends the entire panel width. Additionally, at least one of the horizontal channels preferably has a width greater than one-half (½) the channel width of the vertical channel.

The wall panel assemblies 10 are preferably formed with at least one backside panel 20 connected to the corrugated panel 12, 12'. The backside panel 20 can have attachment points directly on the corrugated panel or can be connected through another structural element, such as structural foam 50. In each arrangement, the backside panel has an inner surface facing toward the corrugated panel's back face and an outer surface facing away from the corrugated panel's back face. As evident from the various wall panel assembly arrangements described below, the backside panel 20 can be a shear panel 18, a backside flat panel 76 (with or without protrusions and indentations), a backside corrugated panel symmetrically mirroring the corrugated panel 78, a backside corrugated panel asymmetrically mirroring the corrugated panel 80, a sandwiched corrugated panel 12, or a combination of these panels.

As shown in FIG. 9, the wall panel assembly has a corrugated core 12, a front facing corrugated panel 12' that serves as a corrugated inside shear panel, and a flat outer shear panel 18*a* that are mated together in a sandwiched structure. The wall panel assembly is similar to existing structural insulated panels (SIPs) but with additional shear support next to the rigid foam core with an additional inner corrugated core. The corrugated core 12 preferably has multiple corrugations 62 with a uniform pitch, but the depth of at least one of the corrugations (from the crest to the trough) is preferably shallower than the depths of the other corrugations. The front facing corrugated panel 12' has one or more vertical installation channels 14' that are aligned and mate with the shallow corrugation in the corrugated core and also has several horizontal installation channels 16' that are aligned and mate with the horizontal channels 16. Accordingly, as indicated above, the horizontal and vertical channels in the corrugated core are complementary to the horizontal and vertical installation channels in the front facing corrugated panel 12'. Each one of horizontal installation channels 16' preferably has the same depth that intersect with the vertical channel, and the channel depths could be varied as long as the depths are matched by the corresponding horizontal channels 16. The channels 14, 16 have solid bottoms 52 with sloping sidewalls 54. The sloping sidewalls allow for identically shaped corrugated panels to be stored and transported in tightly packed stacks and to be individually removed from the stack without the panels binding to each other.

Figure 9B:
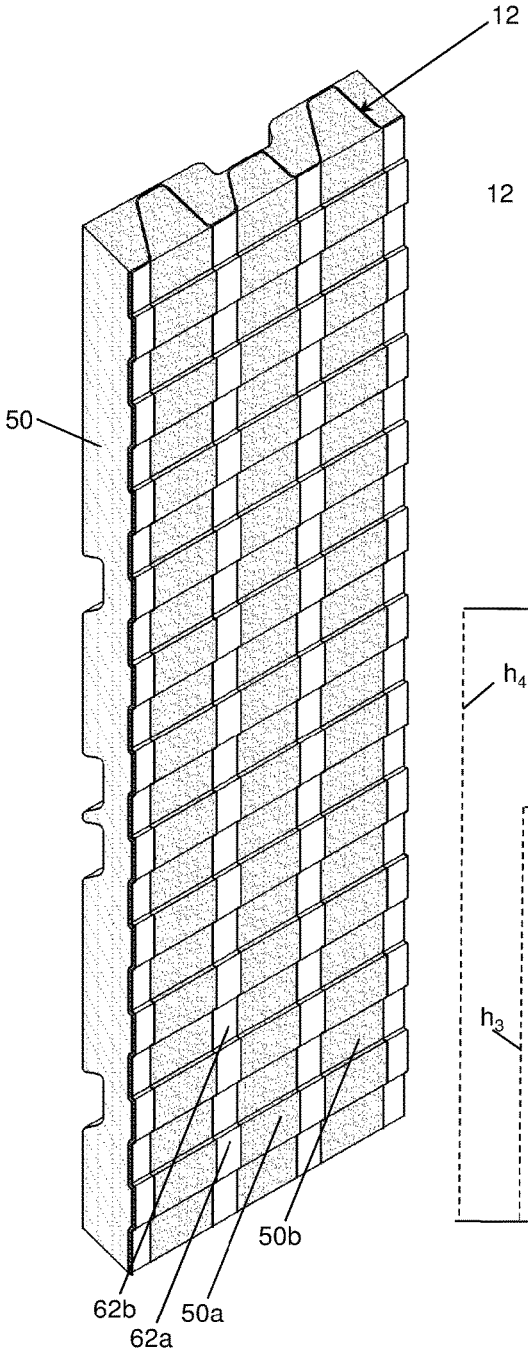
FIG. 9B is an isometric view of the trapezoidal corrugated core panel shown in FIG. 9A with insulation material.
Figure 9C:
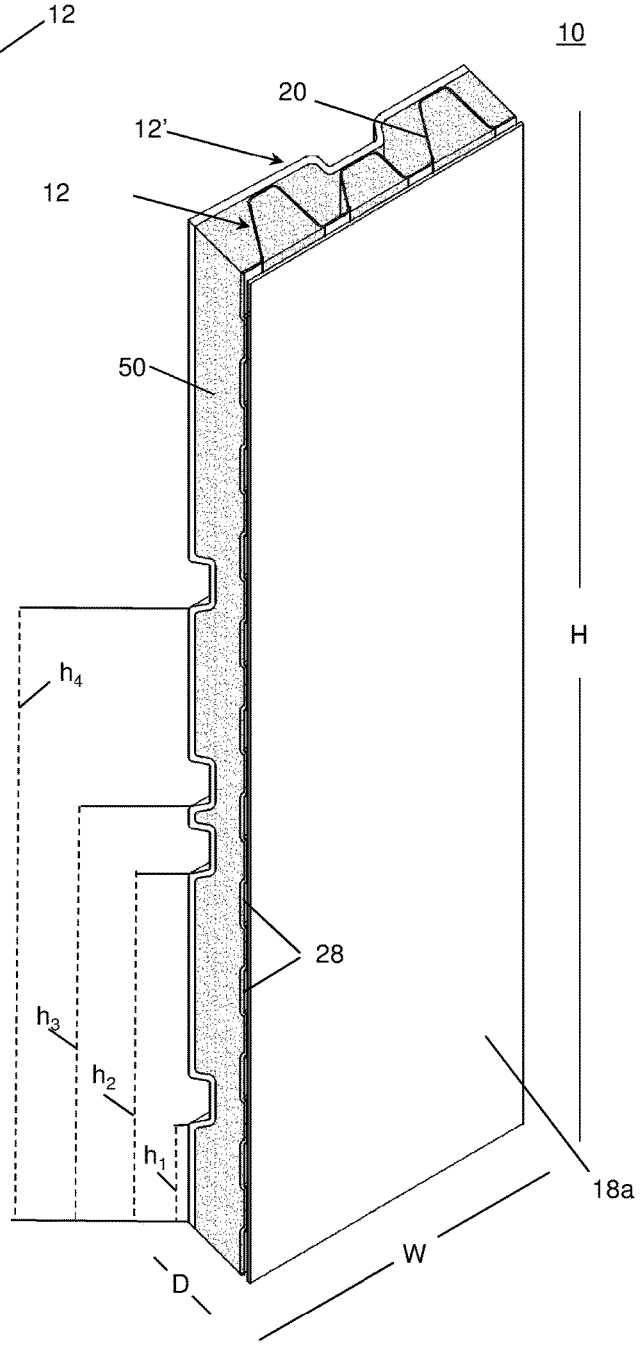
FIG. 9C is an isometric view of the assembled unit shown in FIG. 9A.

The back face of each one of the corrugated core's corrugations (i.e. the face mating with the outer shear panel and facing away from the inner shear panel) are preferably formed with a series of alternating protrusions 62*a* and indentations 62*b*. Similarly, as shown in FIG. 9B, a structural insulation, such as a foam core 50, that fits in the vertical corrugations on the back side of the corrugated core would also have the alternating protrusions 50*a* and indentations 50*b* that are aligned with the alternating protrusions and indentations on the back face of the corrugations so the alternating protrusions and indentations run horizontally across the width of the panel. When the corrugated core is mated with the outer shear panel, as shown in FIG. 9C, the protrusions contact the outer shear panel, and the indentations produce the slots 28 that receive the male end 34*a* of the channel connector 34. As indicated above, the surfaces of the corrugated inside shear panel and corrugated inner core can be attached to each other, with mechanical fasteners 60*a*, adhesive fasteners 60*b* or both, to create a rigid connection between the components.

The insulation material could be made of various materials such as synthetic foams (polyurethane, polystyrene, or polyethylene), various mineral oil based foams, or a variation of plant fibre based products which could be bound through various glues 60*b* or biological adhesion such as natural resins or mushroom based products. Rigid foam inserts could be formed in the same shape as the interior spaces between the panels, matching the corrugation patterns, to create continuous slots 28 so the assemblies can be cut to any width and co-nested with singled side comb shaped channel connectors. The lightweight materials for the wall panel assembly can be installed to create a wall by one or two individuals, depending on the particular size of the panels being installed.

Figure 10A:
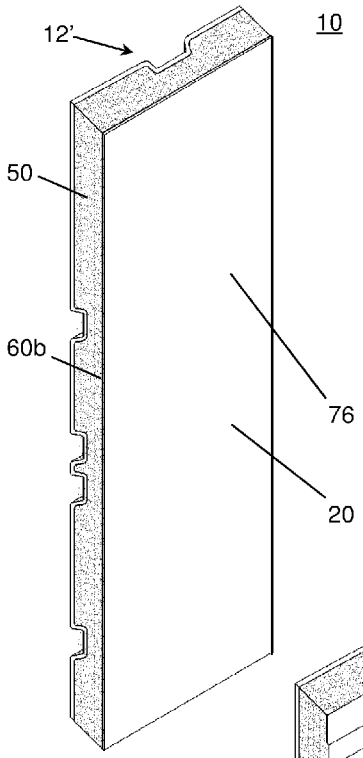
FIGS. 10A-10D are isometric views of alternative variations for the intersecting channel assembly with a structural foam core.
Figure 10B:
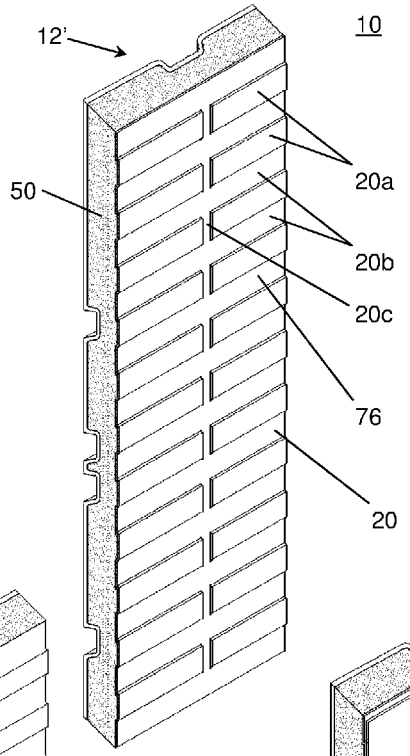
Figure 10C:
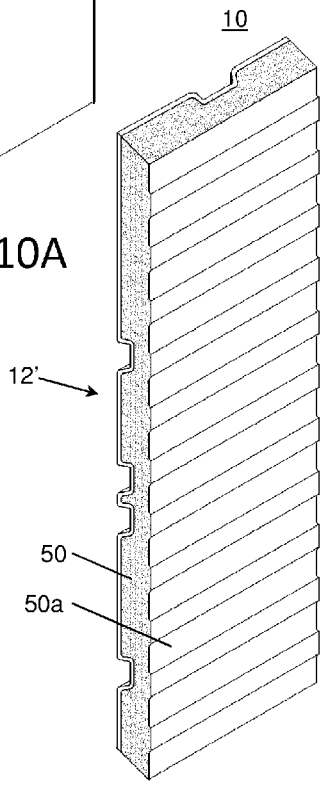
Figure 10D:
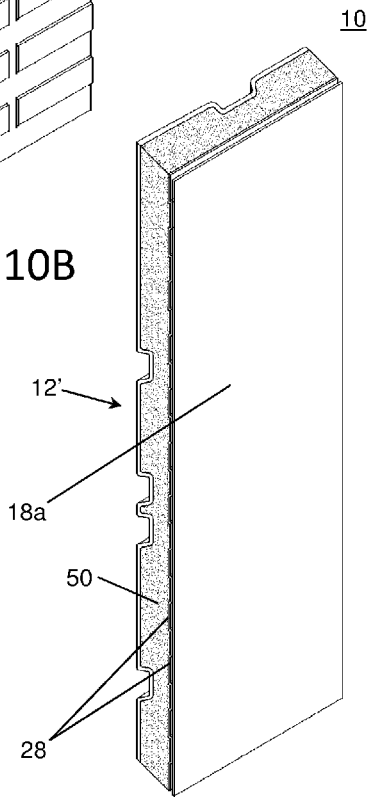

FIGS. 10A-10D show alternative variations of wall panel assemblies that are similar to the assembly described above with reference to FIG. 9, but there is no corrugated core panel between the front facing corrugated panel 12' and the backside panel 20. FIG. 10A has thermal foam insulation 50 adhesively connected with glue 60*b* between two shear layers, with the inner shear panel being corrugated with the horizontal installation channels intersecting the vertical installation channel. FIG. 10B shows the structural foam core 50 molded to the front facing corrugated panel 12'. A backside panel 20 with vertically spaced alternating horizontal protrusions 20*a* and indentations 20*b* and at least one vertical indentation 20*c* that intersects with the horizontal protrusions. The vertical indentation allows for ventilation of condensation in humid environments. As shown in FIG. 10C, the back side of the foam core 50 can also be formed with the alternating protrusions 50*a* and indentations 50*b* that run horizontally across the entire width of the foam core. FIG. 10D shows the additional outer shear panel 18*a* which is clad either directly to the foam core as shown in FIG. 10C or is clad to the backside panel to create the slots 28 for the panel connectors 34.

Figures 11A, 11B:
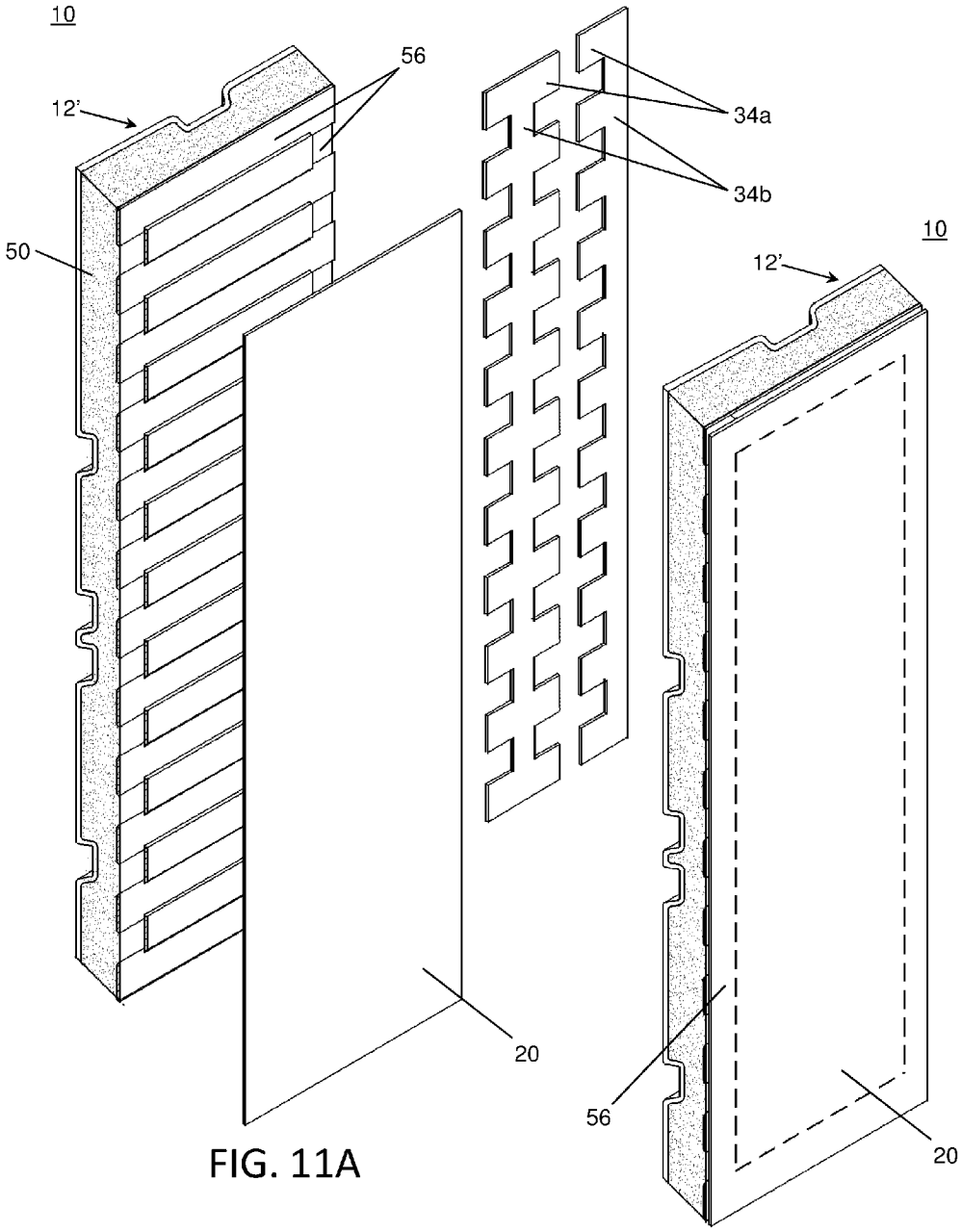
FIG. 11A is an exploded isometric view of another intersecting channel assembly with alternative connectors.
FIG. 11B is an isometric view of the assembled unit shown in FIG. 11A.
Figure 11C:
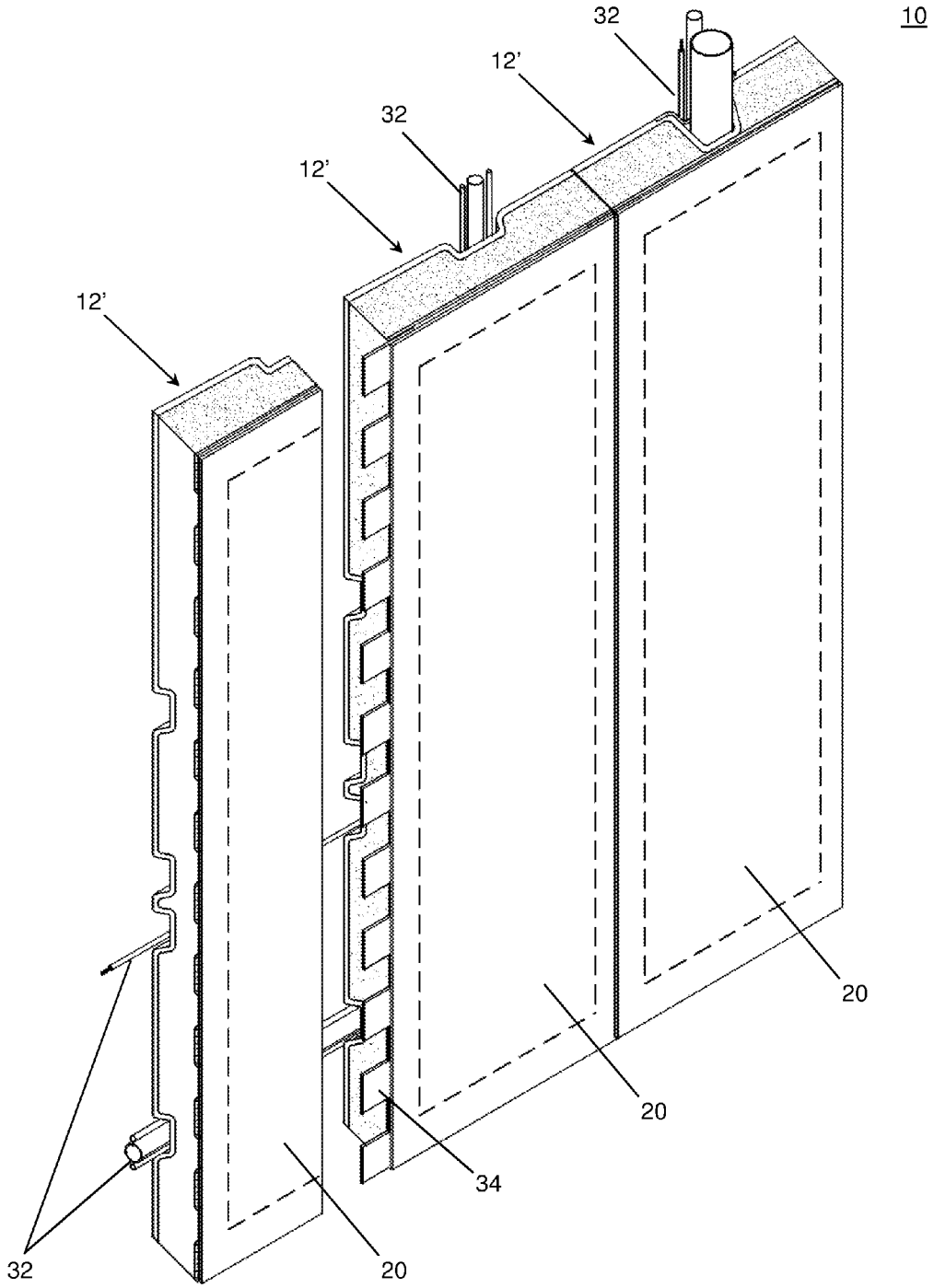
FIG. 11C is an isometric view of installed wall panel assemblies with intersecting channel panels having vertical channels of different depths and a cut wall panel assembly.

The wall panel assemblies shown in FIGS. 11A-11C are similar in construction to the wall panel assemblies shown in FIG. 10. These assemblies are reinforced have rabbets on all four (4) sides to accommodate panel connectors, the top plate, and the bottom plate. As particularly shown in FIGS. 11A and 11B, the rabbet 56 runs along each side of the SIP assembly. The outer rabbet portions of the slots 28 accommodate the spine 34*a* of the panel connectors 34. The connection of adjacent wall panel assemblies, full width and custom cut widths, using panel connectors is shown in FIG. 11C. The drawing shows plumbing and electrical conduits running in the vertical and horizontal installation channels. The slots 28 allow the custom cut assembly to be connected with a channel connector between the adjacent assemblies. The connector's spine fit within the rabbet portion of the assembly, and the connector's teeth project into the slots, allowing a strong and flush butt-joint between the adjacent wall panels assemblies.

FIGS. 12A and 12C show vertical cross-sections of wall panel assemblies with trapezoidal corrugated core panels having vertical channels of different depths, and FIGS. 12B and 12D respectively show the horizontal cross-sections. As shown in FIGS. 12A and 12B, the corrugated core has multiple corrugations with a uniform pitch and a uniform depth (D), measured from the crest to the trough, that is less than the internal thickness (T) of the wall panel assembly to accommodate the depth of the vertical and horizontal recesses ($d_v$=T−D, $d_h$=T−D) in the front facing corrugated panel 12'. As shown in FIGS. 12C and 12D, the corrugated core has multiple corrugations with a uniform pitch, but the depth (D1) of at least one of the corrugations is preferably shallower than the depths (D2) of the other corrugations. The wall panel assembly shown in FIG. 12C has an outer shear panel with horizontal channels/chambers to accommodate the connectors, a front corrugated panel, and a corrugated core panel that has horizontal channels and the shallow depth corrugation to product the complementary shape to the contour of the recessed horizontal and vertical channels in the front corrugated panel. The complementary shape allows the corrugated core panel and the front corrugated panel to be attached to each other on a much larger surface area than the design with the uniform depth corrugated core as shown in FIG. 12A. The larger surface area and the complementary shape allow for stronger connections with glue or fasteners between the various components to create a more durable composite.

Figure 13A:
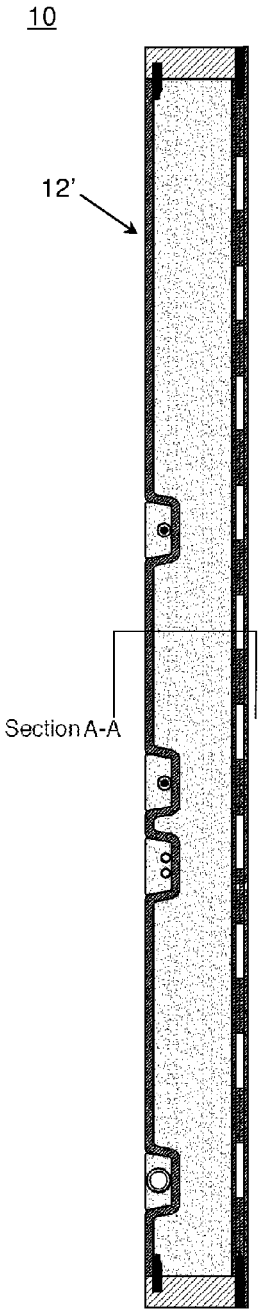
FIG. 13A is a vertical cross-section of a wall panel assembly with conduits in the horizontal channels.
Figure 13B:
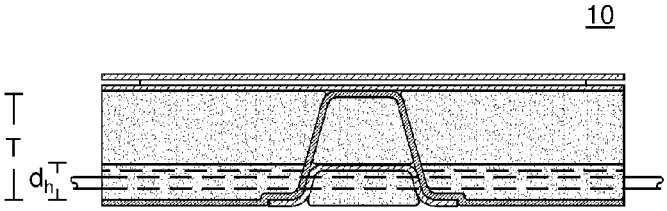
FIGS. 13B-13D are horizontal cross-sections of the wall panel assembly shown in FIG. 13A with alternative installations of conduits and braces in the vertical channel.
Figure 13C:
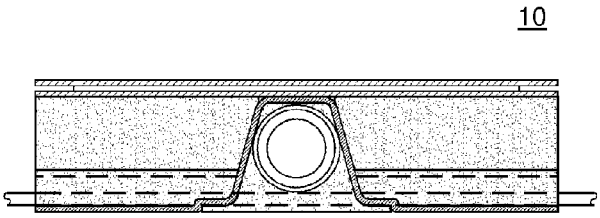
Figure 13D:
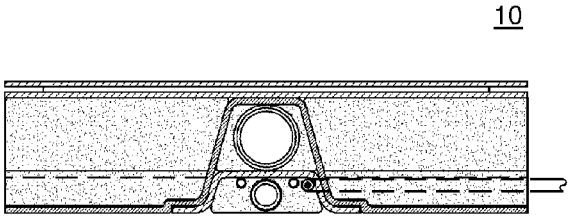
Figure 13F:
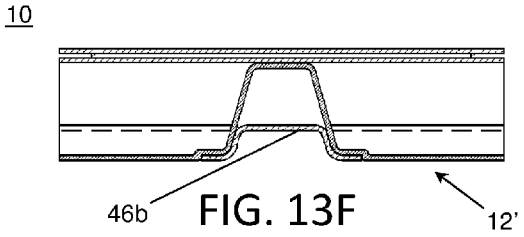
FIGS. 13E and 13F are a front view and a horizontal cross-section, respectively, of the wall panel assembly shown in FIG. 13A.
Figure 13H:
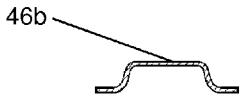
FIGS. 13G-13I are front, top and side views, respectively, of the vertical channel brace shown in FIG. 13E.
Figure 13E:
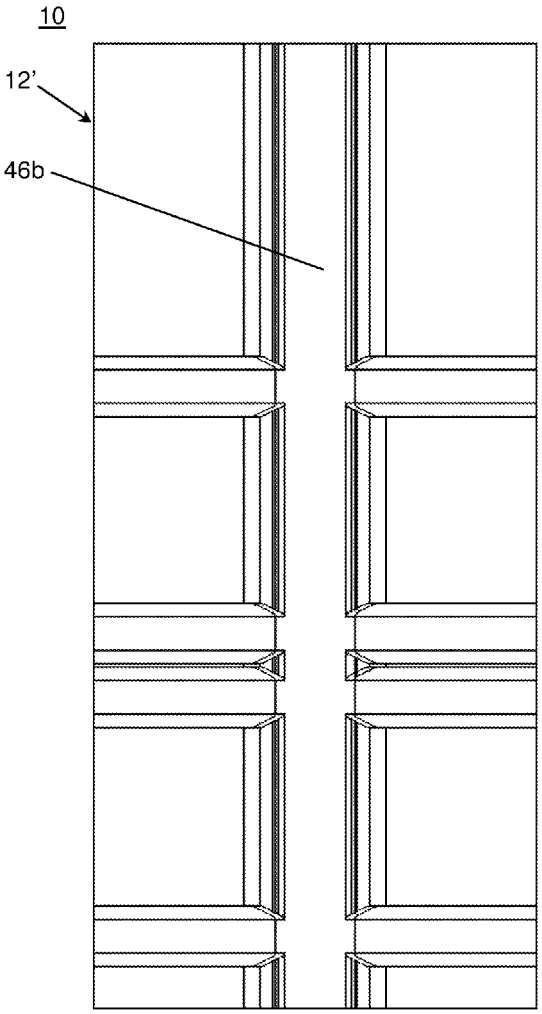

FIGS. 13A-13F show a wall panel assembly in which the front corrugated panel has a deep vertical installation channel ($d_v$) that spans the entire internal depth of the assembly (T), i.e., the vertical channel is equal to the internal thickness of the assembly ($d_v$=T), and is deeper than the depth of the horizontal channels ($d_h$). The deep vertical installation channel allows for space to accommodate larger drain and sewage pipes in the vertical channel. As explained above, the front corrugated panel also has the several horizontal channels which allows the installation of the electrical conduits and components and smaller size plumbing conduits and components, such as freshwater lines and drains for sinks. FIG. 13B shows the assembly with a channel brace and a conduit in the horizontal channel. FIG. 13C shows a variation of the assembly without a channel brace that creates sufficient space to accommodate a large sewage pipe in the vertical installation channel and to also accommodate an electrical conduit in the horizontal channel in front of the sewage pipe. FIG. 13D shows another variation of the assembly with a stacked vertical installation of a smaller size sewage line behind a channel brace and additional electrical conduits and smaller plumbing conduits in front of the channel brace. FIGS. 13E and 13F are a front view and horizontal cross-section, respectively, of the front corrugated panel with the channel brace installed.

Figures 13G, 13I:
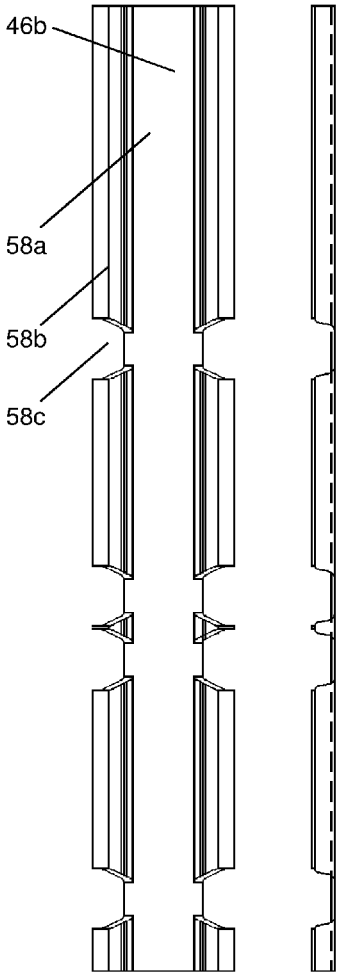

The channel brace 46*b* is shown in FIGS. 13G, 13H, and 13I. The channel brace spans the width and height of the vertical channel. The channel brace has a recessed center section 58*a* between wings 58*b* projecting from the sides of the channel brace. The wings contact the sloping sidewalls of the vertical channel and the center section is recessed from the wings by a depth that is equal to the depth of the horizontal channels. The wings also have cutout sections 58*c* at each intersection between the horizontal channels and the vertical channel.

Figure 14A:
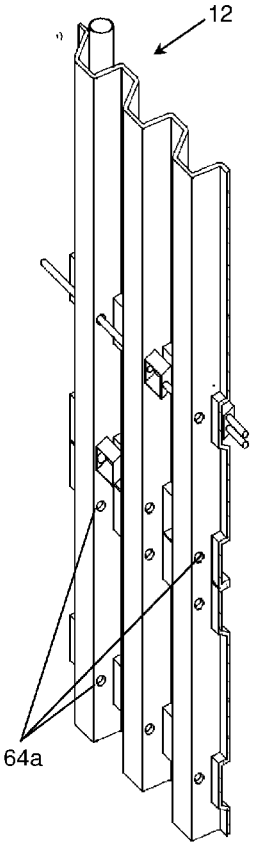
FIGS. 14A and 14B are back and front perspective views, respectively, of the trapezoidal corrugated core panels with conduits on both sides.
Figure 14B:
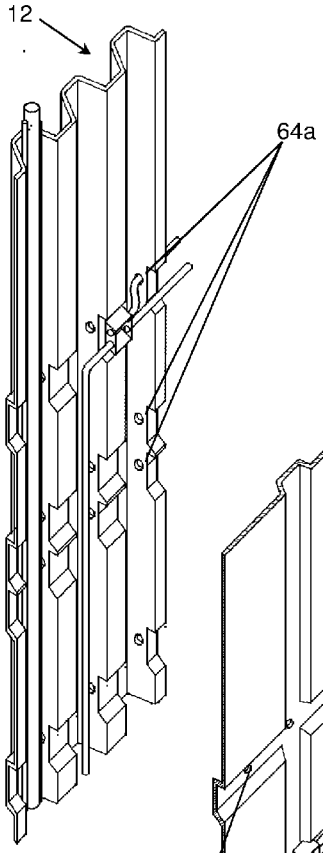

The back and front views of the corrugated core panel 12 are shown in FIGS. 14A and 14B, respectively. The panel has apertures 64*a* in the sidewalls of the vertical channels. The apertures allow conduits to be fed from one side of the panel to the other side of the panel allowing for the installation of opposite facing components, such as junction boxes (j-box) on the backside of the horizontal installation channels. As explained above, components on opposite sides of the wall is beneficial for interior walls, providing easy access to install plumbing and electrical on either side of the wall. The illustrations show various installations of plumbing and electrical conduits with a j-box and show an electrical conduit fed through a hole 64*a* from the front of the panel to the backside of the panel.

Figure 14C:
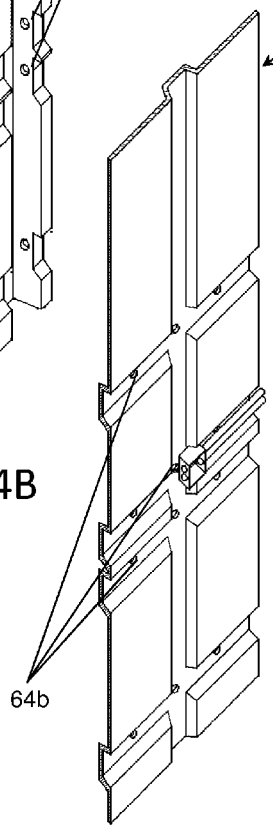
FIGS. 14C and 14D are front perspective views of an intersecting channel panel by itself and in a wall panel assembly with a trapezoidal corrugated core panel.
Figure 14D:
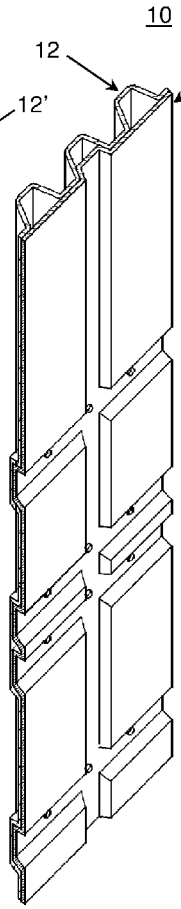
Figure 14E:
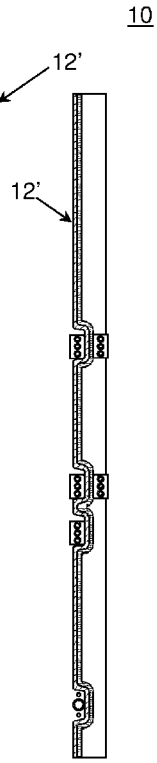
FIG. 14E is a vertical cross-section of the wall panel assembly with the intersecting channel panel mated with the trapezoidal corrugated core panel.

FIG. 14C shows the front face of a front facing corrugated panel 12' that has horizontal installation channels recessed from the front face by the same depth as the vertical installation channel. In the front corrugated panel, apertures or other cut-outs 64*b* are made in the solid bottom of the channels. The holes allow electrical and/or plumbing lines to pass through the panel between the front and back faces. By reducing the number of vertical channels, the area of the planar vertical surfaces is enlarged which increases shear resistance. As explained above and shown in FIGS. 14D and 14E, the corrugated core panel and the corrugated inner shear panel have complementary horizontal and vertical channels and are glued to each other or otherwise attached to each other. The use of the front corrugated panel with the corrugated core panel increases the surface area for a much more flexible installation and sturdier attachment of wall hung objects, such as cabinets, rails, curtains, and art work as compared to conventional stick framing which limit sturdy connections to those locations where a fastener is placed in a wall stud (usually only found every 16"). With the larger surface area for installations, fasteners can be screwed into a solid plant fiber based panel instead of less sturdy drywall with an empty space in the wall or wall studs that are only located only at distinct positions along the wall.

Figures 15A, 15B, 15C, 15D, 15E, 15F:
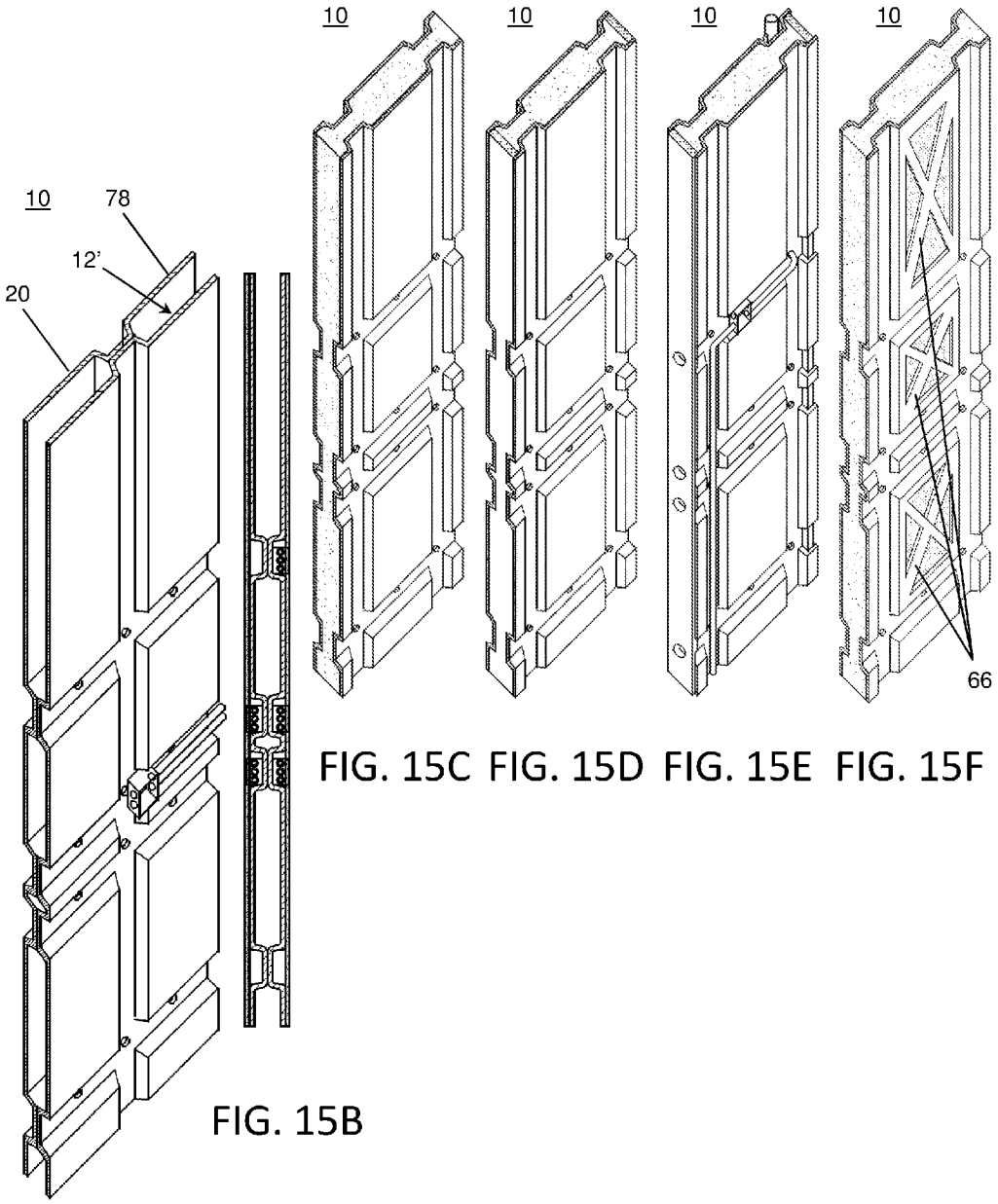
FIGS. 15A and 15B are a perspective view and a vertical cross-section, respectively, of a wall panel assembly with symmetric back to back intersecting channel panels.
FIGS. 15C-15F are perspective views of wall panel assemblies with alternative symmetric back to back intersecting channel panels.

As indicated above, double-sided corrugated cores could be formed with symmetric corrugated panels that mirror each other. Examples of symmetric mirroring corrugated panels are shown in FIGS. 15A-15F and 16A-16D. FIGS. 15A and 15B respectively show a perspective view and vertical cross-section of back to back corrugated front panels that symmetrically mirror each other. Similar to the complementary back to back corrugated panels described above, the symmetrically mirroring corrugated panels include holes in the panels to allow for the conduits to be threaded from one side of the wall to the other side of the wall. FIG. 15B also shows wallboard sheathing 42 on both sides of the sandwiched wall panel assembly.

The wall panel assembly shown in FIG. 15A has a single vertical channel on each side of the assembly, and the back to back panels contact each other directs. As evident from FIGS. 15C-15F, the panels do not need to be directly attached to each other and can be connected through a sandwiched center, such as a structural insulation core or a corrugation core. Additionally, the panels can have multiple vertical channels. As shown in FIG. 15D, a vertical structural member, e.g. a wood stud can be milled to match the contour between the back to back panels. The stud is sandwiched in between panels to create an even sturdier shear wall assembly. The contoured stud allows the conduits to span adjacent assemblies in the horizontal installation channels without making any onsite modifications to the assembly. Alternatively, as shown in FIG. 15E, a standard framing stud can be used by notching the short sides of the wall panel to fit the stud. The stud shows additional holes that allow for the conduits to span adjacent assemblies in the horizontal installation channels. In this embodiment, the stud on one side of the panel protrudes half way past the edge of the panel to provide an attachment point for the next panel. On the opposite side of the protruding stud, another stud is set back half of its thickness into the panel to accommodate space for the protruding stud of the next adjacent panel to enter this opening and provide a strong connection between the different panels. FIG. 15F shows a wall panel with additional cutouts in the large vertical surfaces of the corrugated inside shear panel. The cutouts reduce the weight and amount of material required and are preferably in the form of a planar truss structure 66 to provide structural support in the vertical surfaces.

Figure 16A:
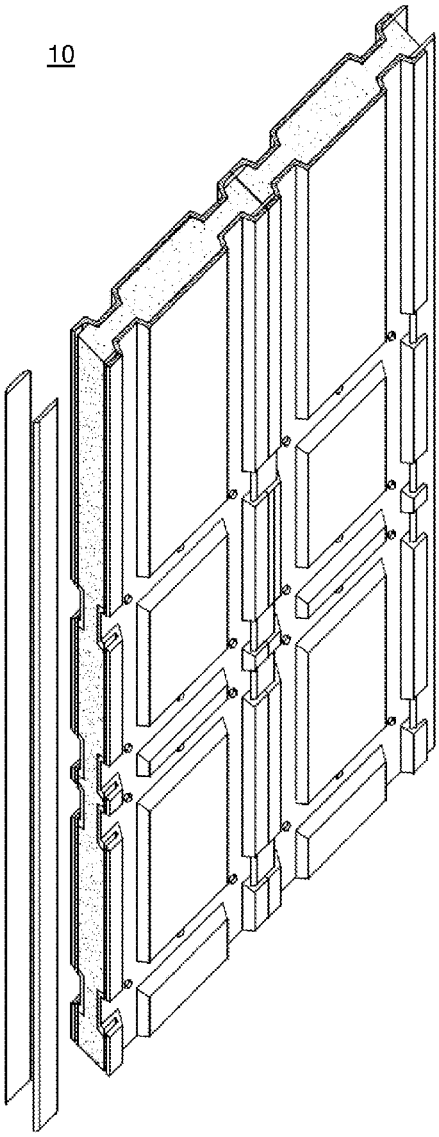
FIGS. 16A-16D perspective views of wall panel assemblies with alternative connectors between the assemblies.
Figure 16B:
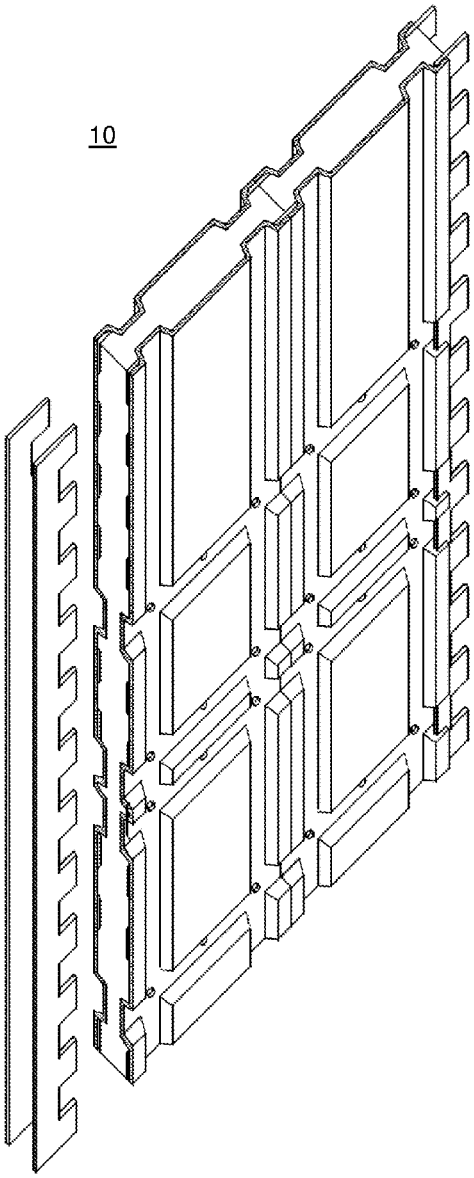
Figure 16C:
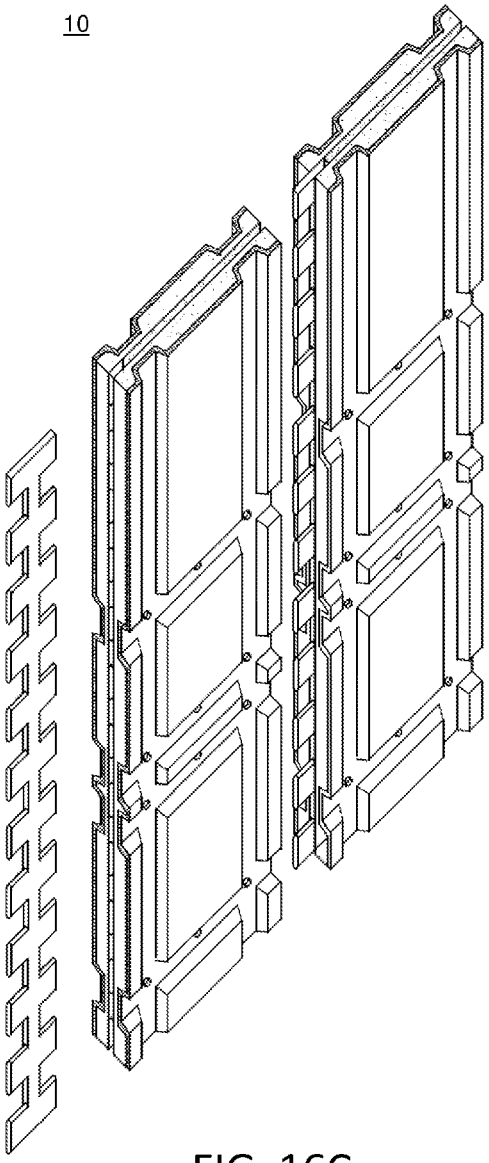
Figure 16D:
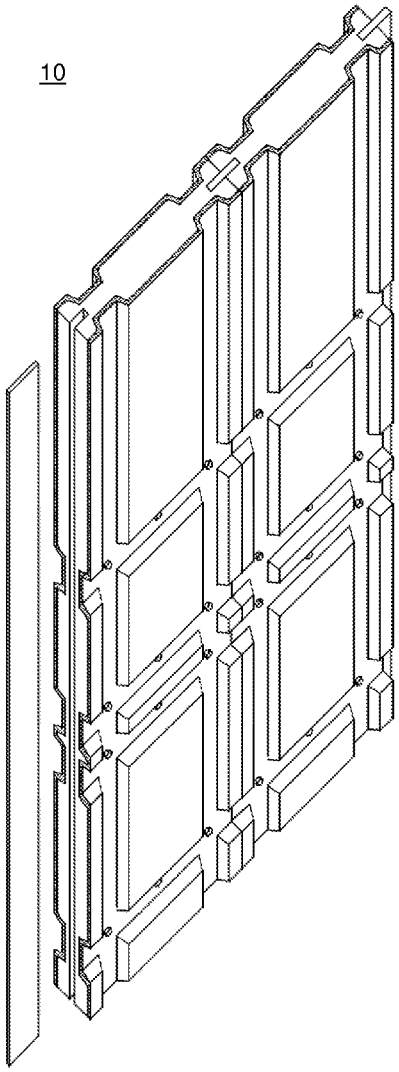

FIGS. 16A-16D show the connection of various wall panel assemblies. FIG. 16A shows two adjacent panels connected to each other using a pair of wood strips inserted into respective slots between the structural foam core and the front corrugated panels. FIG. 16B shows the teeth of a pair of the comb-shaped connectors inserted into the slots which provides a more precise connection between the assemblies. FIG. 16C has back to back structural foam cores with a rabbet on the end as shown in FIG. 11A which produces horizontal chambers corresponding to the shape of the comb-shaped channel connectors and which allows one of the adjacent assemblies to be custom cut to any width and connected by the channel connector to the uncut adjacent assembly. FIG. 16D shows wood strips inserted in rabbet slots of adjacent wall panel assemblies. If a full width and a custom cut wall panel assembly are joined, an additional vertical slot can be cut into the cut side of custom cut assembly.

Double-sided corrugated cores could also be formed with front corrugated panels that mirror each other asymmetrically, such as shown in FIGS. 17 and 18. In FIGS. 17A-17J, a double-sided corrugated core has some vertical installation channels with the same depth as the horizontal installation channel and also has a deep vertical installation channel with a depth that extends the internal depth of the wall panel assembly. In FIGS. 18A-18E, a double-sided corrugated core also has some vertical installation channels with the same depth as the horizontal installation channel and also has a vertical installation channel that is deeper than the horizontal channels, but the depth of the deeper vertical channel only extends to the recessed horizontal channels in the opposite panel. Since these configurations allow for components on opposite sides of the wall, they are well suited for interior walls.

Figure 17A:
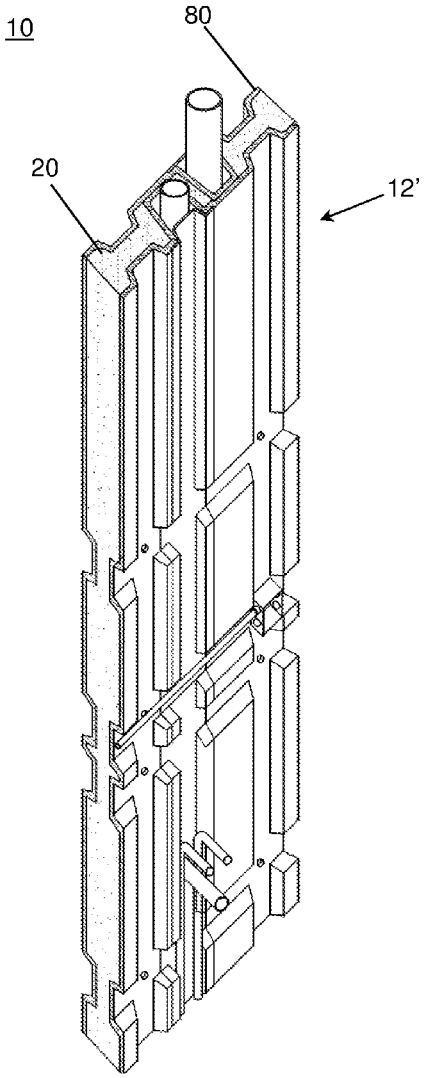
FIGS. 17A and 17C are perspective views of wall panel assemblies with mirroring asymmetric intersecting channel panels having deep channels.

The deeper vertical channels create sufficient space to install larger size drainage pipes inside the wall, especially the vertical channels having the full depth of the assembly as shown in FIG. 17A. The deep channel is preferably placed off center so that the panel can be flipped around its vertical axis and used as the counterpart on the opposite side (i.e., asymmetric mirroring) to create the wall panel assembly. This construction allows for a structurally sound connection between both panels without the need of a structural foam core, although insulation material may still be used if desired for a particular application. The outer facing surfaces of the full-depth vertical channels have horizontal recesses or cutouts at the locations of and corresponding in shape to the backside of the horizontal channels of the opposite panel, and the horizontal channels of the opposite panel fit inside these recesses or cut-outs. The recesses or cut-outs are made in such way that both panels can be stacked back to back onto each other. The intersection allows creates a large planar vertical area where both panels touch and can be connected with each other creating a strong structural connection between both back to back inner shear panels.

Figure 17B:
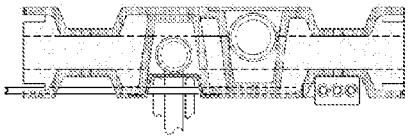
FIGS. 17B and 17D are top views of the wall panel assemblies in FIGS. 17A and 17C, respectively, with deep mirroring asymmetric intersecting channel panels.

FIG. 17B shows a top view of the wall panel assembly in FIG. 17A, showing the alternating depth of the vertical channels of both panels. The entire wall panels form an isolated core. The assembly shows the installation of electrical components and an electrical conduit running through the horizontal installation channels. Additionally, a large drain pipe is installed inside one of the deep vertical channels which is covered with a bracket, such as a strip of wood, and a smaller diameter drain pipe is installed in the other large vertical channel covered with a channel brace to create a mounting surface for various plumbing lines located in the bottom part of the wall panels. As evident, the lip of the j-box extends outwardly from the front surface of the panel into a cutout in the wallboard that covers the panels.

Figure 17C:
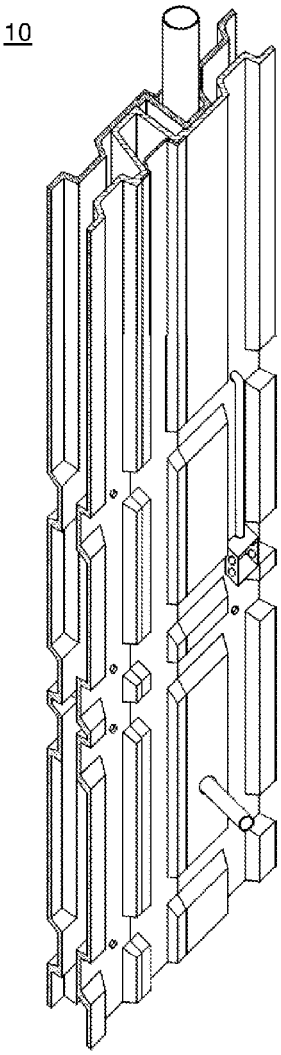
Figure 17D:
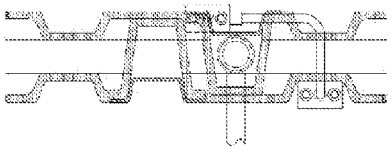
Figure 17E:
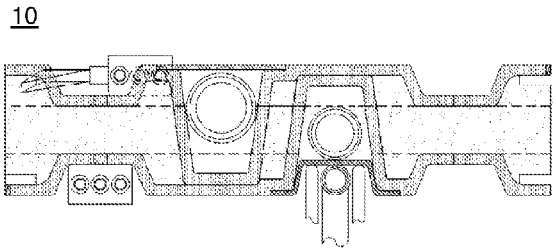
FIGS. 17E and 17F are top views of representative wall panel assemblies with deep mirroring asymmetric intersecting channel panels.
Figure 17F:
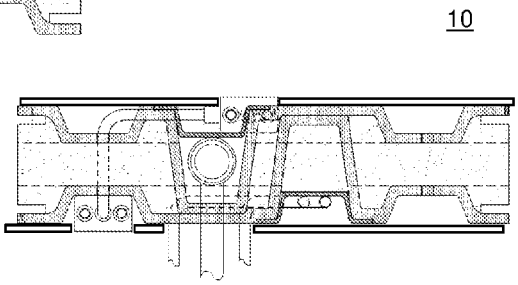
Figure 17G:
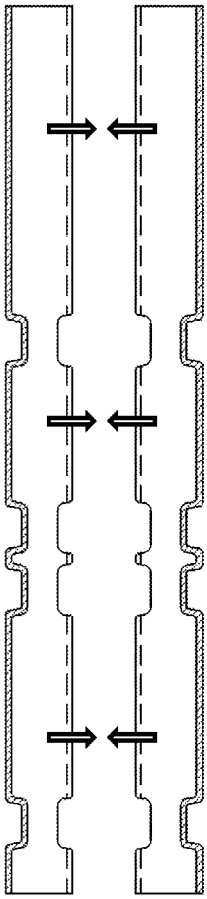
FIGS. 17G and 17H are side views of mirroring asymmetric intersecting channel panels with deep vertical channels.
Figure 17H:
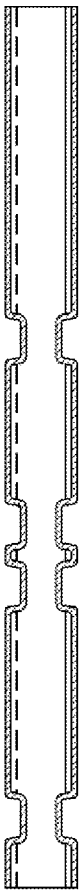
Figure 17I:
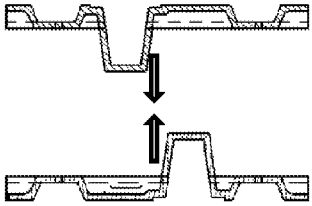
FIGS. 17I and 17J are top views of mirroring asymmetric intersecting channel panels with deep vertical channels.
Figure 17J:
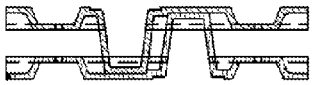

FIG. 17C has the same configuration of panels as in FIG. 17A, but it does not have any insulation between the panels. This embodiment shows the installation of electrical j-boxes on opposite sides of the wall panel assembly with an electrical conduit fed from one side to the opposite side of the panel through apertures in the panels. This embodiment also shows a plumbing conduit fed through a custom cut hole in the deep vertical channel. FIG. 17D shows a top view of the wall panel assembly in FIG. 17C, showing how the electrical conduit is led from one side of the panel through the center to the opposite side of the panel and how the drain pipe is fed through the custom cut hole in the deep vertical channel and through the vertical surface in the opposite panel. The side views in FIGS. 17G, 17H, 18B, and 18C and the top views in FIGS. 17I, 17J, 18D, and 18E show how the panels overlap with their mirroring asymmetric designs.

Figure 19A:
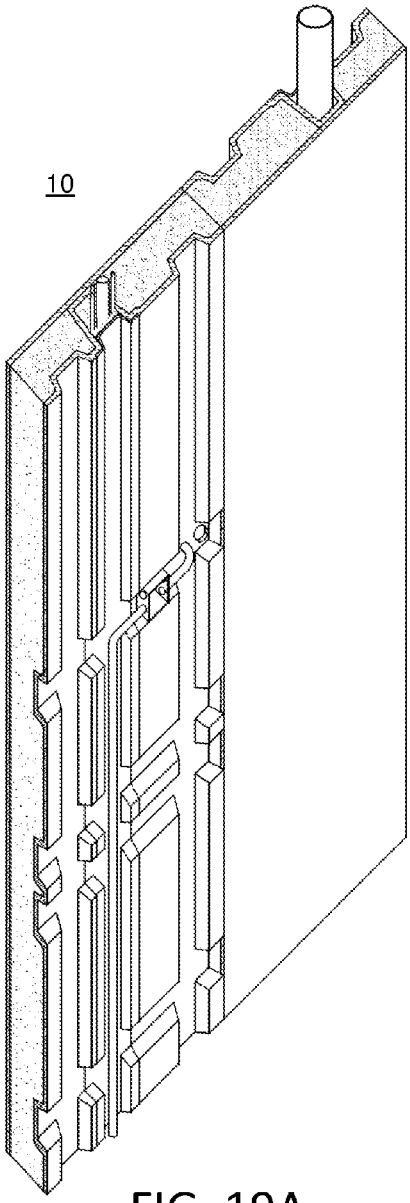
FIGS. 19A and 19B are perspective views of non-mirroring asymmetric wall panel assemblies facing in different directions.
Figure 19B:
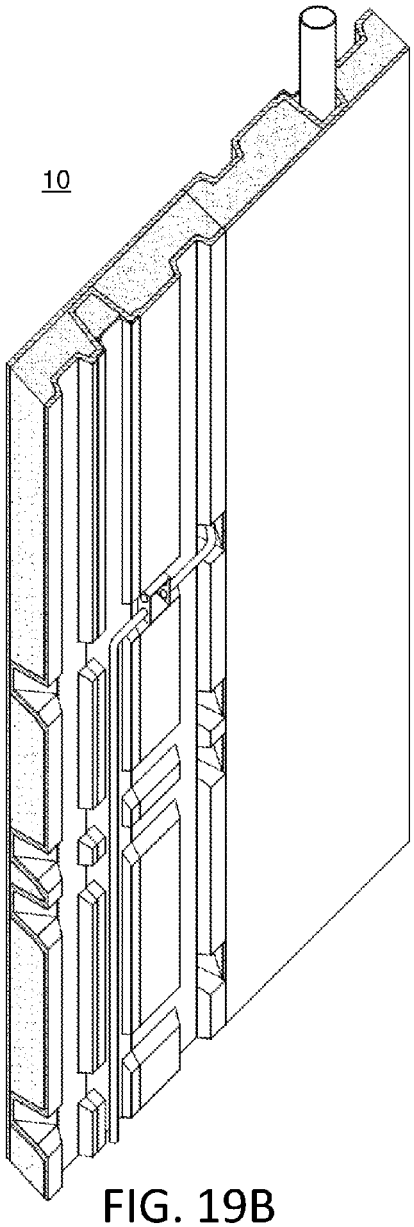
Figure 19C:
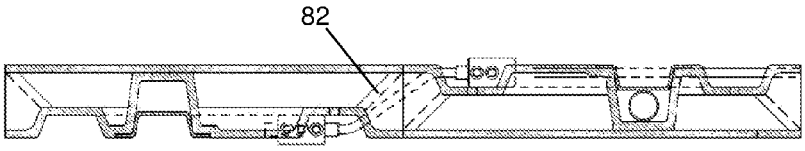
FIG. 19C is a horizontal cross-section of the wall panel assembly in FIG. 19B.

The non-mirroring asymmetric wall panel assemblies shown in FIG. 19 also allow for components to be installed on opposite sides of the wall so they are also well suited for interior walls. However, these wall panel assemblies alternate the side of the wall to which the horizontal and vertical channels open. As shown in FIGS. 19A and 19B, two (2) adjacent wall panel assemblies are placed with the channels opening to different sides of the wall. In the configuration shown in FIG. 19A, to connect the horizontal installation channels on one side with the horizontal installation channels on the other side, a hole can be cut in the assembly between the channels. In the configuration shown in FIG. 19B, the vertical back part of the beginning and end section of the each horizontal installation channel is angled towards the inside surface of the outer shear panel creating a diagonal passage 82 from the front side towards the backside of each panel, allowing for an easy transition of electrical and plumbing conduits between the alternating assemblies. The horizontal cross-section of the assembly of FIG. 19B, shown in FIG. 19C, shows an electrical conduit passing through the diagonal passage from front face of one assembly to the front face of the other alternating assembly.

Figure 20A:
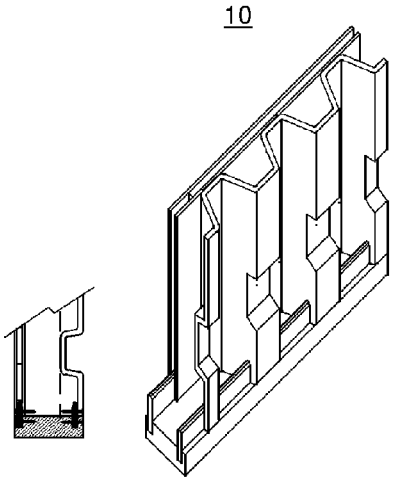
FIGS. 20A-20C are detail perspective views and corresponding vertical cross-sections of wall panel assemblies mounted to a bottom plate.
Figure 20B:
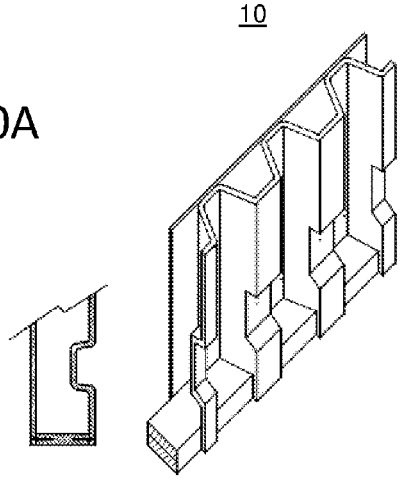
Figure 20C:
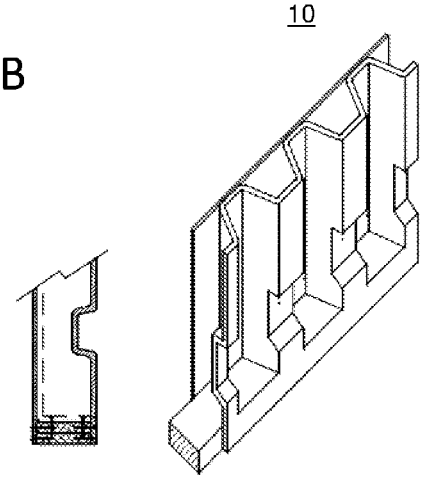

FIGS. 20A, 20B, and 20C show how the various panels are connected to a bottom plate. In FIG. 20A, the bottom plate has two (2) rails projecting up into the wall panel which fit into matching slots running parallel to the short side on the inside and the outside of the wall panel. The bottom plate and the wall panel would be nailed, screwed, stapled or bolted through the corrugated core/the outer shear panel into the matching rail. In FIG. 20B, a standard size framing stud without any rails is used for the same purpose. The corrugated core is notched on the bottom to match the contour of the bottom plate. In FIG. 20C, the bottom portion of the corrugated core is formed in such a way that it creates a nailing surface parallel to the top of the bottom plate and the turn 90° towards to run parallel to the side of the bottom plate. This allows the corrugated core to be attached to the bottom plate both vertically and horizontally.

Figure 21:
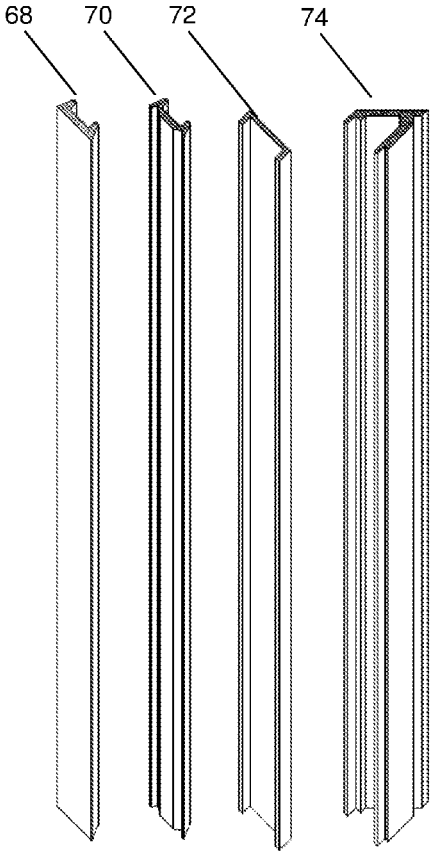
FIG. 21 is a perspective view of various wall panel connectors.

FIG. 21 shows various connectors. A U-shaped channel bridge 68 is inserted into the vertical installation channels in such way that the two (2) legs face the side of the vertical channel and the long side of the channel bridge creates a flat surface parallel to the interior side of the of the inside shear panel. This channel bridge is used to create a strong connection with perpendicular wall panels. An alternative bridge 70 has two (2) angled, recessed vertical surfaces which allow the placement of mechanical connectors, like screws or nails at an angle to create a strong structural bond between the wall panel and the channel bridge. This alternative bridge avoids nail or screw heads from protruding past the inside surface of the wall panel, which would result in an interference with connecting parts and imprecise installation. A U-shaped extrusion 72, or end connector, is used to connect perpendicular wall panels with each other. The flat side of the U-shaped end connector is mechanically fastened to the wall panel perpendicular to the next wall panel, with the legs face the short side of the next panel. The U shaped extrusions or legs are inserted into the matching vertical slots found on the short side of the perpendicular wall panels and nailed or screwed to the perpendicular wall panel. A V-shaped extrusion 74, such as a 45° connector, can be used connect wall panels to each other in a 45° angle (or other angle corresponding with the connector angle). The long flat side of the extrusion is attached to the adjacent wall, with the parallel protrusions or legs protruding outwards 45° away from the standing wall. The wall panel that is to be connected to the 45° connector features two vertical slots on the short side of the panels, corresponding in shape to the two parallel protrusions on the 45° connector. The wall panel is slipped over the two parallel protrusions of the 45° connector and is mechanical fastened to the 45° connector.

Figure 22:
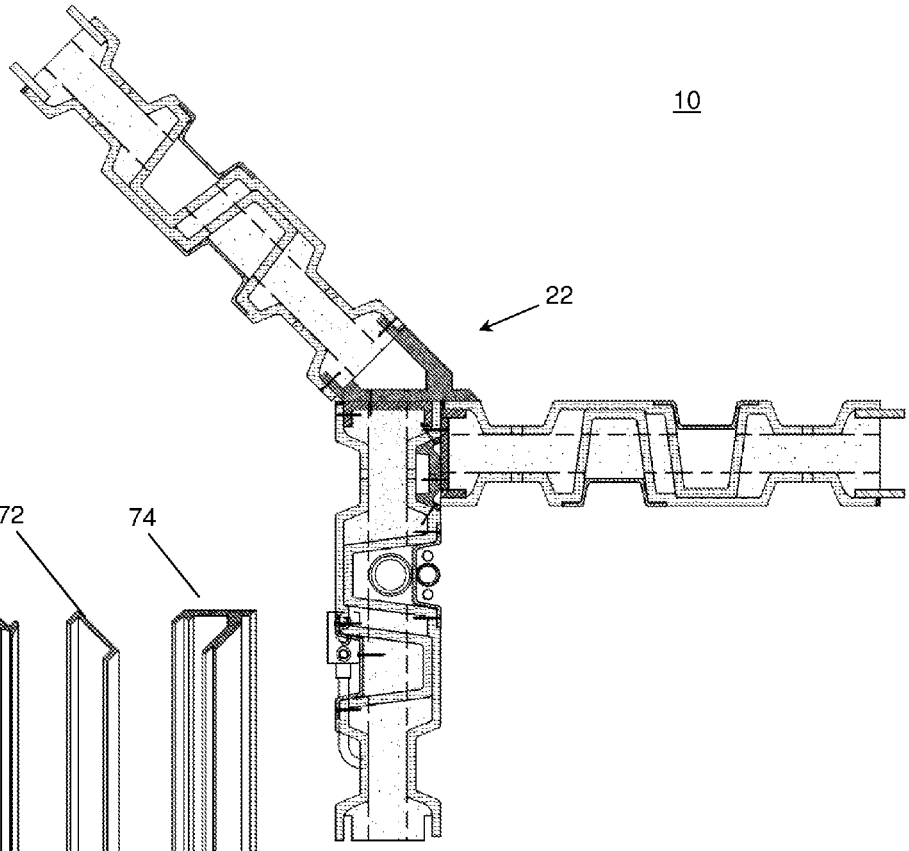
FIG. 22 is a horizontal cross-section through a corner of a wall panel assembly with varying wall angles.

FIG. 22 shows an assembly of various wall panels at different angles. The channel brace, channel bridge, end connector and 45° connector connected the adjacent wall panel assemblies. The connectors are mechanically connected using nails in the particular example.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A wall system for construction of a building, comprising:

a corrugated panel having a top side, a bottom side, a first side end, a second side end, a front face, and a back face, the corrugated panel comprising at least one vertical channel and a plurality of horizontal channels, wherein the corrugated panel has a panel width between the first side end and the second side end, wherein the vertical channel is recessed from the front face by a first depth and extends between the bottom side and the top side and has a vertical channel width less than one third the panel width, wherein the horizontal channels are recessed from the front face by a second depth and extend the entire panel width from the first side end to the second side end and intersect with the vertical channel between the first side end and the second side end, wherein a lowermost horizontal channel most proximate to the bottom side of the corrugated panel is spaced a first distance from the bottom side of the corrugated panel, wherein an uppermost horizontal channel is spaced a second distance from the top side of the corrugated panel, wherein the second distance is different from the first distance, wherein a third distance between a first pair of the horizontal channels adjacent to each other is greater than a fourth distance between a second pair of the horizontal channels adjacent to each other, and wherein a panel wall thickness between the front face and the back face is thinner than the first depth.

2. The wall system of claim 1, wherein the plurality of horizontal channels is further comprised of a plurality of middle horizontal channels distributed between the lowermost horizontal channel and the uppermost horizontal channel, wherein the third distance is greater than the vertical channel width, and wherein the fourth distance is less than the vertical channel width, wherein each one of the horizontal channels and the vertical channel have a solid bottom between a pair of sloping sidewalls, and wherein the vertical channel and the horizontal channels are open to the front face of the corrugated panel and closed to the back face of the corrugated panel.

3. The wall system of claim 1, further comprising an aperture between the front face and the back face.

4. The wall system of claim 1, further comprising a second corrugated panel situated adjacent to the corrugated panel with a flush joint between the corrugated panel and the second corrugated panel, wherein the second corrugated panel has a pair of side ends, a second top side, a second bottom side, a second front face, and a second back face, the second corrugated panel comprising a second vertical channel and a set of horizontal channels, wherein the second corrugated panel has a second panel width between the pair of side ends, wherein the second vertical channel is recessed from the second front face by the first depth and extends between the second bottom side and the second top side, and wherein the set of horizontal channels are recessed from the second front face by the second depth and extend the entire second panel width between the pair of side ends and intersect with the second vertical channel.

5. The wall system of claim 1, wherein the plurality of horizontal channels in the corrugated panel are distributed at varying heights relative to the bottom side, wherein a third distance between a first pair of adjacent horizontal channels is greater than a fourth distance between a second pair of adjacent horizontal channels.

6. The wall system of claim 1, further comprising a backside panel with a first face facing toward the corrugated panel's back face and a second face facing away from the corrugated panel's back face, wherein the corrugated panel and the backside panel are connected to form a first structural panel assembly with an interior space.

7. The wall system of claim 6, further comprising a hole extending from a first aperture in one of the horizontal channels in the corrugated panel through the interior space to a second aperture in the backside panel.

8. The wall system of claim 7, further comprising an insulation material in the interior space between the corrugated panel and the backside panel, wherein the hole extends through the insulation material, wherein the backside panel is spaced from the corrugated panel, wherein the insulation material connects the backside panel to the corrugated panel, and wherein the first depth of the vertical channel is equal to the second depth of the horizontal channels.

9. The wall system of claim 6, further comprising a second structural panel assembly adjacent to the first structural panel assembly and a connector extending between and attaching the second structural panel assembly to the first structural panel assembly, wherein the second structural panel assembly is comprised of a second corrugated panel and a second backside panel, wherein the second corrugated panel is comprised of a second vertical channel and a second set of horizontal channels, wherein the second set of horizontal channels are recessed into the second structural panel assembly by the same second depth as the plurality of horizontal channels are recessed into the first structural panel assembly, wherein the plurality of horizontal channels in the first structural panel assembly are distributed at varying heights relative to the bottom side, and wherein the second set of horizontal channels in the second structural panel assembly are respectively aligned with the plurality of horizontal channels at each one of the varying heights.

10. The wall system of claim 9, further comprising a j-box, a plurality of conduits, and an interior wall panel, wherein the second corrugated panel has a side end adjacent to at least one of the corrugated panel's first side end the backside panel, wherein the j-box is situated in at least one of the horizontal channels and the vertical channel, wherein the conduits are situated in the horizontal channels and the vertical channel, wherein at least one of the conduits extends between the first structural panel assembly and the second structural panel assembly and connects with the j-box, and wherein the conduits are selected from the group of conduits consisting of plumbing pipes, electrical power lines, electrical communication wires, HVAC ducts, central vacuum tubes, and any combination thereof, wherein the interior wall panel covers the conduits in the horizontal channels, and wherein the interior wall panel has a cutout over the j-box.

11. The wall system of claim 1, wherein the vertical channel partially extends between the top side and the bottom side of the corrugated panel, and wherein the vertical channel comprises an end surface spanning the first depth from a bottom of the vertical channel to the front face.

12. The wall system of claim 1, further comprising a plurality of vertical channels and a channel brace spanning at least one of the vertical channels.

13. A wall system for construction of a building, comprising:

a corrugated panel having a top side, a bottom side, a first side end, a second side end, a front face, and a back face, the corrugated panel comprising at least one vertical channel and a plurality of horizontal channels, wherein the corrugated panel has a panel width between the first side end and the second side end, wherein the vertical channel is recessed from the front face by a first depth and extends between the bottom side and the top side and has a vertical channel width less than one third the panel width, wherein the horizontal channels are recessed from the front face by a second depth and extend between the first side end and the second side end and intersect with the vertical channel, and wherein a panel wall thickness between the front face and the back face is thinner than the first depth; and a channel brace spanning the vertical channel, wherein the first depth of the vertical channel is greater than the second depth of the horizontal channels, wherein the channel brace has a recessed center section between a plurality of wings, wherein the recessed center section has a depth equal to the second depth, and wherein the wings have cutout sections at each intersection between the horizontal channels and the vertical channel.

14. The wall system of claim 13, further comprising a backside panel with a first face facing toward the corrugated panel's back face and a second face facing away from the corrugated panel's back face, wherein the corrugated panel and the backside panel are connected to form a first structural panel assembly with an interior space.

15. The wall system of claim 14 further comprising a second structural panel assembly adjacent to the first structural panel assembly and a connector extending between and attaching the second structural panel assembly to the first structural panel assembly, wherein the second structural panel assembly is comprised of a second corrugated panel and a second backside panel, wherein the second corrugated panel is comprised of a second vertical channel and a second set of horizontal channels, wherein the second set of horizontal channels are recessed into the second structural panel assembly by the same second depth as the plurality of horizontal channels are recessed into the first structural panel assembly, wherein the plurality of horizontal channels in the first structural panel assembly are distributed at varying heights relative to the bottom side, and wherein the second set of horizontal channels in the second structural panel assembly are respectively aligned with the plurality of horizontal channels at each one of the varying heights.

16. A wall system for construction of a building, comprising:

a corrugated panel having a panel height between a top side and a bottom side, a panel width between a first side end and a second side end, a panel wall thickness between a front face and a back face, and a corrugation depth measured from a front face peak to a back face peak, the corrugated panel comprising at least one vertical channel and a plurality of horizontal channels, wherein the vertical channel has a length extending the entire panel height between the bottom side and the top side and has a first channel width less than one third the panel width and is recessed from the front face by a first depth, wherein the horizontal channels have a second width extending the entire panel width between the first side end and the second side end and intersect with the vertical channel and are recessed from the front face by a second depth, wherein at least one of the first depth and the second depth defines the corrugation depth, wherein at least one of the horizontal channels has a width greater than one-half the channel width of the vertical channel, wherein a lower horizontal channel is proximate to the bottom side and is spaced a first distance from the bottom side, wherein a middle horizontal channel is proximate to a center of the corrugated panel, wherein an upper horizontal channel is above the center of the corrugated panel and is spaced a second distance from the top side, and wherein the second distance is different from the first distance;

a backside panel connected to the corrugated panel to form a first structural panel assembly, wherein the backside panel is comprised of an inner surface facing toward the corrugated panel's back face and an outer surface facing away from the corrugated panel's back face, and wherein the backside panel is selected from a group of panels consisting of a shear panel, a backside flat panel, a backside corrugated panel symmetrically mirroring the corrugated panel, a backside corrugated panel asymmetrically mirroring the corrugated panel, a sandwiched corrugated panel, and any combination thereof; and an interior space between the corrugated panel and the backside panel.

17. The wall system of claim 16, wherein each one of the horizontal channels and the vertical channel have a solid bottom between a pair of sloping sidewalls, wherein a first set of apertures is formed in at least one of the solid bottom and the sloping sidewalls, wherein a second set of apertures is formed in the backside panel, wherein the first depth and the second depth are greater than the panel wall thickness, and wherein the vertical channel and the horizontal channels are open to the front face of the corrugated panel and closed to the back face of the corrugated panel.

18. The wall system of claim 17, further comprising a second structural panel assembly adjacent to the first structural panel assembly and a connector extending between and attaching the second structural panel assembly to the first structural panel assembly, wherein the second structural panel assembly is comprised of a second corrugated panel connected to a second backside panel, wherein the second corrugated panel is comprised of a second vertical channel and a second set of horizontal channels, wherein the second set of horizontal channels are recessed into the second structural panel assembly by the same second depth as the plurality of horizontal channels are recessed into the first structural panel assembly, wherein the plurality of horizontal channels in the first structural panel assembly are distributed at varying heights relative to the bottom side, wherein the second set of horizontal channels in the second structural panel assembly are respectively aligned with the plurality of horizontal channels at each one of the varying heights, wherein the first structural panel assembly and the second structural panel assembly each further comprises a plurality of vertical channels with a plurality of varying depths, and wherein the second depth is equal to at least one of the varying depths.

19. The wall system of claim 18, further comprising a j-box, a plurality of conduits, and an interior wall panel, wherein the horizontal channels are further comprised of a plurality of middle horizontal channels distributed between the lower horizontal channel and the upper horizontal channel, wherein a pair of adjacent horizontal channels are spaced from each other by a distance that is greater than the vertical channel width, wherein the j-box is situated in at least one of the horizontal channels and the vertical channel, wherein the conduits are situated in the horizontal channels and the vertical channel, wherein at least one of the conduits extends between the first structural panel assembly and the second structural panel assembly and connects with the j-box, and wherein the conduits are selected from the group of conduits consisting of plumbing pipes, electrical power lines, electrical communication wires, HVAC ducts, central vacuum tubes, and any combination thereof, wherein the interior wall panel covers the conduits in the horizontal channels, and wherein the interior wall panel has a cutout over the j-box.

20. A wall system for construction of a building comprising:

a first structural panel assembly having an assembly height between a top side and a bottom side, an assembly width between a first side end and a second side end, the first structural panel assembly comprising a corrugated panel connected to a backside panel and an interior space between the corrugated panel and the backside panel, wherein the corrugated panel has a corrugation depth and is comprised of at least one vertical channel and a plurality of horizontal channels, wherein the vertical channel has a length extending the entire assembly height between the bottom side and the top side and has a first channel width less than one third the assembly width and is recessed from the front face by a first depth, wherein the horizontal channels have a second width extending the entire panel width between the first side end and the second side end and intersect with the vertical channel and are recessed from the front face by a second depth, wherein at least one of the first depth and the second depth defines the corrugation depth, wherein at least one of the horizontal channels has a width greater than one-half the channel width of the vertical channel, wherein the plurality of horizontal channels in the first structural panel assembly are distributed at varying horizontal channel heights relative to the bottom side, wherein the backside panel is comprised of an inner surface facing toward the corrugated panel's back face and an outer surface facing away from the corrugated panel's back face, and wherein the backside panel is selected from a group of panels consisting of a shear panel, a backside flat panel, a backside corrugated panel symmetrically mirroring the corrugated panel, a backside corrugated panel asymmetrically mirroring the corrugated panel, a sandwiched corrugated panel, and any combination thereof;

a second structural panel assembly comprising a second corrugated panel connected to a second backside panel, wherein the second corrugated panel is comprised of a second vertical channel and a second set of horizontal channels, wherein the second set of horizontal channels are recessed into the second structural panel assembly by the same second depth as the plurality of horizontal channels are recessed into the first structural panel assembly, wherein the second set of horizontal channels in the second structural panel assembly are respectively aligned with the plurality of horizontal channels at each one of the varying horizontal channel heights, wherein the first structural panel assembly and the second structural panel assembly each further comprises a plurality of vertical channels with a plurality of varying depths, and wherein the second depth is equal to at least one of the varying depths; and a connector extending between and attaching the second structural panel assembly to the first structural panel assembly.

21. The wall system of claim 20, further comprising a j-box, a plurality of conduits, and an interior wall panel, wherein an insulation material is situated in the interior space and connects the backside panel to the corrugated panel, wherein the j-box is situated in at least one of the horizontal channels and the vertical channel, wherein the conduits are situated in the horizontal channels and the vertical channel, wherein at least one of the conduits extends between the first structural panel assembly and the second structural panel assembly and connects with the j-box, and wherein the conduits are selected from the group of conduits consisting of plumbing pipes, electrical power lines, electrical communication wires, HVAC ducts, central vacuum tubes, and any combination thereof, wherein the interior wall panel covers the conduits in the horizontal channels, and wherein the interior wall panel has a cutout over the j-box.

22. The wall system of claim 20, further comprising a top plate connected to the first structural panel assembly at the top side and connects the backside panel to the corrugated panel, a bottom plate connected to the bottom side of the first structural panel assembly, a third structural panel assembly connected to at least one of the first structural panel assembly and the second structural panel assembly, and a fourth structural panel assembly connected to at least one of the first structural panel assembly and the second structural panel assembly, wherein the third structural panel assembly forms an interior wall core and is further comprised of horizontal channels opening outwardly on each side of the interior wall, and wherein the fourth structural panel assembly forms an exterior wall core and is further comprised of a single horizontal channel proximate to the bottom side and a window frame positioned above the single horizontal channel.

23. A wall system for construction of a building, comprising:

a first corrugated panel having a first pair of side ends, a first top side, a first bottom side, a first outer face, and a first inner face, the first corrugated panel comprising at least one vertical channel and a first set of horizontal channels, wherein the first corrugated panel has a first panel width between the first pair of side ends, wherein the vertical channel is recessed from the first outer face by a first depth and extends between the first bottom side and the first top side and has a first vertical channel width less than one third the first panel width, wherein the horizontal channels are recessed from the first outer face by a second depth and extend the entire first panel width between the first pair of side ends and intersect with the first vertical channel, wherein the first set of horizontal channels are distributed at varying heights relative to the first bottom side, and wherein the first corrugated panel further comprises an aperture between the first outer face and the first inner face; and a second corrugated panel situated adjacent to the first corrugated panel with a flush joint between the first corrugated panel and the second corrugated panel, wherein the second corrugated panel has a second pair of side ends, a second top side, a second bottom side, a second outer face, and a second inner face, the second corrugated panel comprising a second vertical channel and a second set of horizontal channels, wherein the second corrugated panel has a second panel width between the second pair of side ends, wherein the second vertical channel is recessed from the second outer face by the first depth and extends between the second bottom side and the second top side and has a second vertical channel width less than one third the second panel width, wherein the second set of horizontal channels are recessed from the second outer face by the second depth and extend the entire second panel width between the second pair of side ends and intersect with the second vertical channel, wherein the first inner face and the second inner face are flush with each other, and wherein the second set of horizontal channels respectively align with the first set of horizontal channels to form a set of continuous horizontal channels extending the entire first panel width through the flush joint to the entire second panel width.

24. The wall system of claim 23, wherein the first corrugated panel further comprises a plurality of vertical channels, wherein the first set of horizontal channels intersects with each one of the vertical channels, wherein the first set of horizontal channels is further comprised of a plurality of middle horizontal channels distributed between the lowermost horizontal channel and the uppermost horizontal channel, wherein a pair of adjacent horizontal channels are spaced from each other by a distance that is greater than the vertical channel width, and wherein the second set of horizontal channels are recessed into the second corrugated panel by the same second depth as the first set of horizontal channels are recessed into the first corrugated panel.

25. A wall system for construction of a building, comprising:

a corrugated panel having a top side, a bottom side, a first side end, a second side end, a front face, and a back face, the corrugated panel comprising at least one vertical channel and a plurality of horizontal channels, wherein the corrugated panel has a panel width between the first side end and the second side end, wherein the vertical channel is recessed from the front face by a first depth and extends between the bottom side and the top side and has a vertical channel width less than one third the panel width, wherein the horizontal channels are recessed from the front face by a second depth and extend the entire panel width from the first side end to the second side end and intersect with the vertical channel between the first side end and the second side end, wherein a lowermost horizontal channel most proximate to the bottom side of the corrugated panel is spaced a first distance from the bottom side of the corrugated panel, wherein an uppermost horizontal channel is spaced a second distance from the top side of the corrugated panel, wherein a panel wall thickness between the front face and the back face is thinner than the first depth, wherein the second distance is different from the first distance, wherein a third distance between a first pair of the horizontal channels adjacent to each other is greater than a fourth distance between a second pair of the horizontal channels adjacent to each other, and wherein the corrugated panel is further comprised of an aperture between the front face and the back face.

26. The wall system of claim 25, wherein a third distance between a first pair of the horizontal channels adjacent to each other is greater than a fourth distance between a second pair of the horizontal channels adjacent to each other.

27. The wall system of claim 25, further comprising a backside panel with a first face facing toward the corrugated panel's back face and a second face facing away from the corrugated panel's back face, wherein the corrugated panel and the backside panel are connected to form a first structural panel assembly with an interior space.

* * * * *